US010270212B2

(12) United States Patent
Ohkubo et al.

(10) Patent No.: US 10,270,212 B2
(45) Date of Patent: Apr. 23, 2019

(54) SHIELD STRUCTURE, SHIELD SHELL AND METHOD OF MANUFACTURING SHIELD CONNECTOR WITH ELECTRIC WIRE

(71) Applicant: YAZAKI CORPORATION, Tokyo (JP)

(72) Inventors: Yoshitaka Ohkubo, Shizuoka (JP); Miki Nakamura, Shizuoka (JP); Takeshi Innan, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/079,572

(22) Filed: Mar. 24, 2016

(65) Prior Publication Data

US 2016/0211621 A1 Jul. 21, 2016

Related U.S. Application Data

(63) Continuation of application No. PCT/JP2014/078406, filed on Oct. 24, 2014.

(30) Foreign Application Priority Data

Oct. 25, 2013 (JP) ..... 2013-222608

(51) Int. Cl.
*H01R 43/048* (2006.01)
*H01R 13/6596* (2011.01)
(Continued)

(52) U.S. Cl.
CPC ..... *H01R 13/6596* (2013.01); *H01R 13/6593* (2013.01); *H01R 43/048* (2013.01); *H01R 2103/00* (2013.01); *H01R 2201/26* (2013.01)

(58) Field of Classification Search
CPC ..... H01R 13/6596; H01R 13/6593; H01R 43/048; H01R 4/18
(Continued)

(56) References Cited

U.S. PATENT DOCUMENTS 3,366,918 A * 1/1968 Johnson ..... H01R 13/6596 174/359
4,273,405 A 6/1981 Law
(Continued)

FOREIGN PATENT DOCUMENTS

JP 2002-329557 A 11/2002
JP 2010-268562 A 11/2010
(Continued)

OTHER PUBLICATIONS

International Search Report and Written Opinion of the International Search Report for PCT/JP2014/078406 dated Dec. 16, 2014.
(Continued)

*Primary Examiner* — Renee S Luebke
*Assistant Examiner* — Paul D Baillargeon
(74) *Attorney, Agent, or Firm* — Kenealy Vaidya LLP

(57) ABSTRACT

A shield structure includes a shield member which is formed into a hollow tubular shape and a shield shell to which a leading end in the longitudinal direction of the shield member is attached. In the shield structure, the shield shell has a plate-like shell main body through which a through hole is bored, and a plurality of shell tightening pieces which are extended from an outer edge of the shell main body, the shell main body is so arranged that the leading end in the longitudinal direction of the shield member surrounds the through hole, and the leading end in the longitudinal direction of the shield member is clamped by the shell main body and the shell tightening pieces which are bent to the shell main body.

10 Claims, 14 Drawing Sheets

(51) Int. Cl.
*H01R 13/6593* (2011.01)
*H01R 103/00* (2006.01)

(58) Field of Classification Search
USPC ..... 439/607.27, 607.48
See application file for complete search history.

(56) References Cited

U.S. PATENT DOCUMENTS 4,786,260 A * 11/1988 Spaulding ..... H01R 13/424 29/861
5,938,475 A 8/1999 Penner et al.
6,287,148 B1 * 9/2001 Huang ..... H01R 9/032 439/607.41
8,956,189 B2 * 2/2015 Imahori ..... H01R 4/10 439/587
2012/0058674 A1 3/2012 Deno et al.
2014/0045377 A1 2/2014 Okamoto et al.
2014/0238735 A1 8/2014 Adachi et al.

FOREIGN PATENT DOCUMENTS

JP 2012-104417 A 5/2012
JP 2012-252874 A 12/2012
JP 2013-115072 A 6/2013

OTHER PUBLICATIONS

International Preliminary Report on Patentability and English language Written Opinion of the International Search Report for PCT/JP2014/078406 dated Apr. 26, 2014.
German Office Action for the related German Patent Application No. 11 2014 004 863.1 dated Jul. 11, 2017.

* cited by examiner

SHIELD STRUCTURE, SHIELD SHELL AND METHOD OF MANUFACTURING SHIELD CONNECTOR WITH ELECTRIC WIRE

CROSS REFERENCE TO RELATED APPLICATIONS

This application is a continuation of PCT application No. PCT/JP2014/078406, which was filed on Oct. 24, 2014 based on Japanese Patent Application (No. 2013-222608) filed on Oct. 25, 2013, the contents of which are incorporated herein by reference.

BACKGROUND OF THE INVENTION

1. Technical Field

The present invention relates to a shield structure, a shield shell and a method of manufacturing a shield connector with electric wire, and particularly to the structure of a shield shell.

2. Background Art

In JP-A-2010-268562, a shield electric wire fixing structure to attach a braiding of a shield electric wire to a shield shell of a shield connector is described. In the shield electric wire fixing structure of the JP-A-2010-268562, while a braiding 22 is placed on the outer periphery of a small diameter part 41 of a shield shell 40, the braiding 22 is attached to the shield shell 40 by tightening a shield ring 30 to the small diameter part 41.

The small diameter part 41 of the shield shell 40 described in the JP-A-2010-268562 has a hollow cylindrical shape which is extended from a body part 42 of the shield shell 40 in which an inner holder 50 is accommodated. The shield shell 40 including the small diameter part 41 and the body part 42 is molded by being twist-pressed. Further, it is described in a JP-A-2013-115072 that a shield shell is manufactured by die-casting.

SUMMARY OF THE INVENTION

However, for the structure described in the JP-A-2010-268562 to attach the braiding 22 to the shield shell 40 by tightening the shield ring 30, the number of components of the shield connector increases. Therefore, a shield structure is demanded to reduce the component number of the shield connector.

Further, when the shield shell in the structure described in the JP-A-2010-268562 is manufactured by twist-pressing or die-casting, the manufacturing cost increases because of the complexity of the manufacturing methods.

Therefore, a shield shell is demanded for which the shield connector with electric wire can be manufactured by a simpler manufacturing method.

The present invention is made in view of the above circumstances, and the object of the present invention is to provide a shield structure, a shield shell used in the shield structure, and a method of manufacturing a shield connector with electric wire so that while the component number of the shield connector is reduced, the shield connector with electric wire can be manufactured by a simpler manufacturing method.

To achieve the previously described object, the shield structure according to the present invention is characterized by the following (1) to (7).

(1) A shield structure, including a shield member which is formed into a hollow tubular shape, and a shield shell to which the leading end in the longitudinal direction of the shield member is attached, wherein the shield shell has a plate-like shell main body through which a through hole is bored, and a plurality of shell tightening pieces which are extended from the outer edge of the shell main body, the shell main body is so arranged that the leading end in the longitudinal direction of the shield member surrounds the through hole, and the leading end in the longitudinal direction of the shield member is clamped by the shell main body and the shell tightening pieces which are bent to the shell main body.

(2) The shield structure according to (1), wherein the shell tightening pieces are provided equidistantly along the outer edge of the shell main body.

(3) The shield structure according to (1) or (2), wherein the shell tightening pieces are provided with protrusions on surfaces which face the shell main body when the shell tightening pieces are bent to the shell main body.

(4) The shield structure according to (3), wherein the shell tightening pieces are formed with concaves at positions corresponding to the protrusions on surfaces opposite to the surfaces where the protrusions are provided.

(5) The shield structure according to any one of (1) to (4), wherein the shell tightening pieces which are bent to the shell main body extend toward a center of the through hole.

(6) The shield structure according to any one of (1) to (5), wherein a shape of the through hole of the shell main body and a shape that defines the outer edge of the shell main body are round, and a center of the through hole corresponds to a center of the shape of the outer edge of the shell main body.

(7) The shield structure according to any one of (1) to (5), wherein a shape of the through hole of the shell main body and a shape that defines the outer edge of the shell main body are rectangles that are similar to each other, and a center of the through hole corresponds to a center of the shape of the outer edge of the shell main body.

According to the shield structure of the constitution of the above (1), upon attaching the shield member to the shield shell, a shield ring used traditionally becomes needless. Therefore, the component number of the shield connector can be reduced.

According to the shield structure of the constitution of the above (2), the shell main body and the shell tightening pieces can grip the leading end of the shield member equidistantly along the circumferential direction.

According to the shield structure of the constitution of the above (3), the leading end is clamped by the shell main body and the protrusions by a big pressure force.

According to the shield structure of the constitution of the above (4), by forming the protrusions at the time of bend-pressing, the shell tightening pieces can be formed with the protrusions easily.

According to the shield structure of the constitution of the above (5), a range that is wider than the leading end of the shield member can be gripped by the shell main body and the shell tightening pieces.

According to the shield structure of the constitution of the above (6), the shield member can be attached to the center of the shell main body.

According to the shield structure of the constitution of the above (7), the shield member can be attached to the center of the shell main body.

To achieve the previously described object, the shield shell according to the present invention is characterized by the following (8) to (9).

(8) A shield shell, including a plate-like shell main body through which a through hole is bored, and a plurality of shell tightening pieces which are extended from the outer edge of the shell main body, wherein the leading end in the longitudinal direction of a shield member which is arranged to surround the through hole may be clamped by the shell main body and the shell tightening pieces which are bent to the shell main body.

(9) The shield shell according to (8), wherein an angle between a plane including the shell main body and a direction in which the shell tightening pieces are extended is an acute angle.

According to the shield shell of the constitution of the above (8), upon attaching the shield member to the shield shell, a shield ring used traditionally becomes needless. Therefore, the component number of the shield connector can be reduced.

According to the shield shell of the constitution of the above (9), arranging the leading end to conform to the shape of the through hole can be implemented by a simple operation.

To achieve the previously described object, the method of manufacturing a shield connector with electric wire according to the present invention is characterized by the following (10).

(10) A method of manufacturing a shield connector with electric wire including a pressing step of forming a shield shell which has a plate-like shell main body through which a through hole is bored, and a plurality of shell tightening pieces which are extended from the outer edge of the shell main body by pressing a metal plate, an arranging step of arranging the leading end in the longitudinal direction of a shield member which is formed into a hollow tubular shape to the shell main body to surround the through hole, and a bending step of clamping the leading end in the longitudinal direction of the shield member with the shell main body and the shell tightening pieces by bending the shell tightening pieces to the shell main body.

According to the manufacturing method of the shield connector with electric wire of the constitution of the above (10), the shield shell has a shape that is molded only by punch-pressing and bend-pressing. Therefore, the manufacturing method can be simplified in comparison with a traditional manufacturing method of manufacturing a shield shell by twist-pressing or die-casting.

According to the present invention, the component number of the shield connector is reduced and the shield connector with electric wire can be manufactured by a simpler manufacturing method.

The present invention has been briefly described above. Further, details of the invention will become more apparent after embodiments of the invention described below (hereinafter referred to as "embodiments") are read with reference to the accompanying figures.

BRIEF DESCRIPTION OF THE DRAWINGS

FIGS. 3A to 3C are figures to describe the shape of a shield shell of the first embodiment of the present invention, in which FIG. 3A is a front view, FIG. 3B is an A-A line sectional view of FIG. 3A, and FIG. 3C is a perspective view.

FIGS. 4A to 4C are figures to describe the shape of a braiding of the first embodiment of the present invention, in which FIG. 4A is a front view, FIG. 4B is an A-B line sectional view of FIG. 4A, and FIG. 4C is a perspective view.

FIGS. 5A to 5D are figures to describe an operation of attaching the braiding to the shield shell of the first embodiment of the present invention, in which FIGS. 5A to 5D are sectional views to respectively describe one step of the operation.

FIGS. 6A and 6B are perspective views of the shield connector with electric wire of the first embodiment of the present invention, in which FIG. 6A is a perspective view watched from the front side of the shield connector with a electric wire, and FIG. 6B is a perspective view watched from the rear side of the shield connector with a electric wire.

FIGS. 12A to 12C are figures to describe the shape of a shield shell of the second embodiment of the present invention, in which FIG. 12A is a front view, FIG. 12B is a D-D line sectional view of FIG. 12A, and FIG. 12C is a perspective view.

FIGS. 14A to 14B are figures to describe a shield structure of the second embodiment of the present invention, in which FIG. 14A is a perspective view watched from the front side of the shield structure, and FIG. 14B is a perspective view watched from the rear side of the shield structure.

DETAILED DESCRIPTION OF EMBODIMENTS

Specific embodiments of the present invention are described below with reference to the figures. First, the first embodiment of the present invention is described.

First Embodiment

Figure 1:
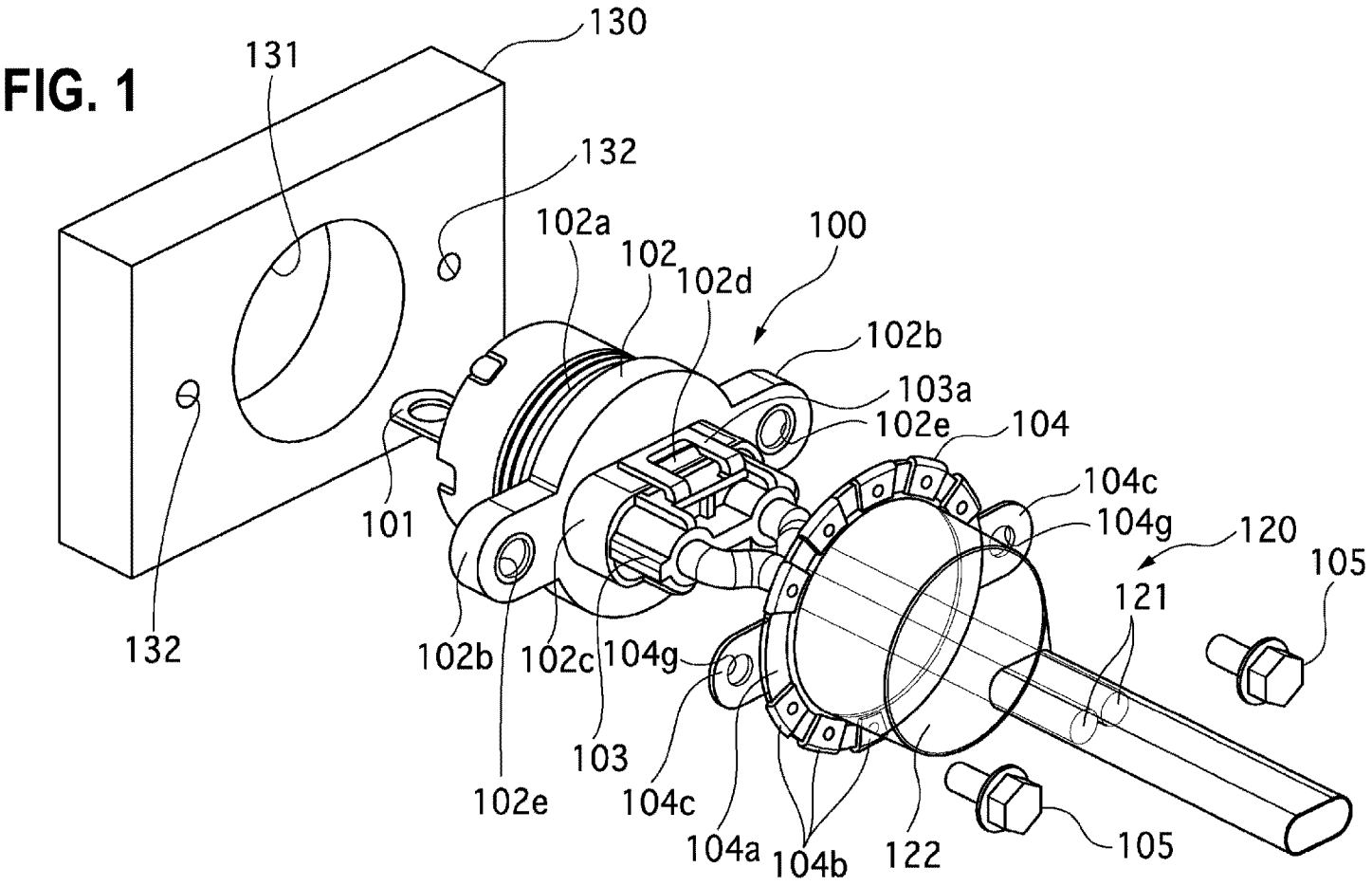
FIG. 1 is an exploded perspective view of a shield connector with electric wire and a device side case of the first embodiment of the present invention.
Figure 2:
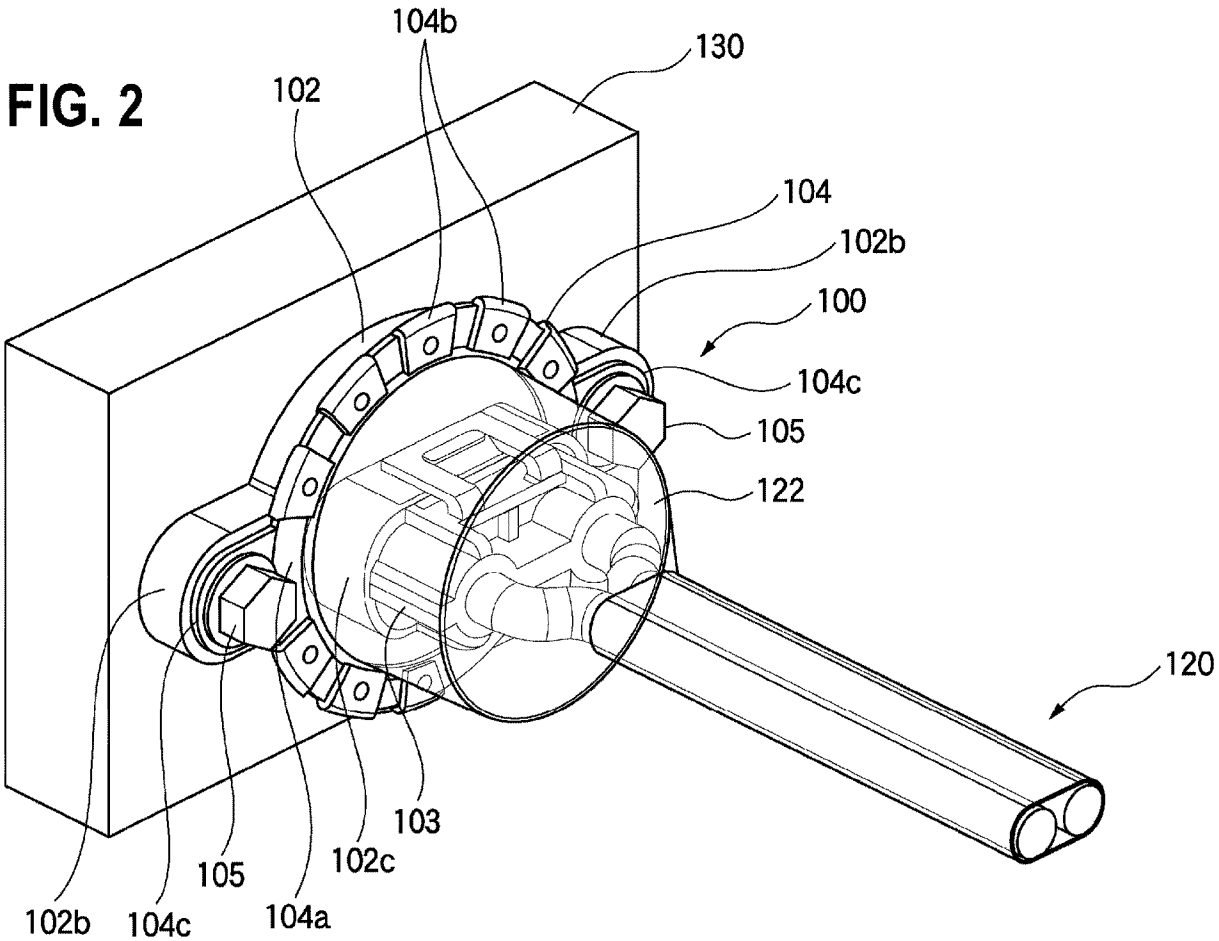
FIG. 2 is a perspective view in which the shield connector with electric wire of the first embodiment of the present invention is attached to the device side case.
Figure 3A:
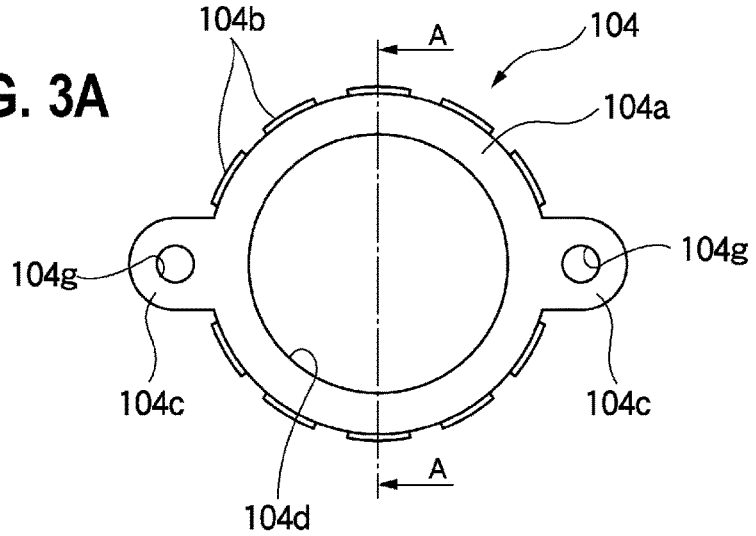
Figure 3B:
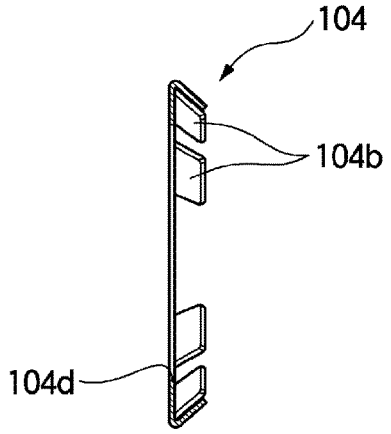
Figure 3C:
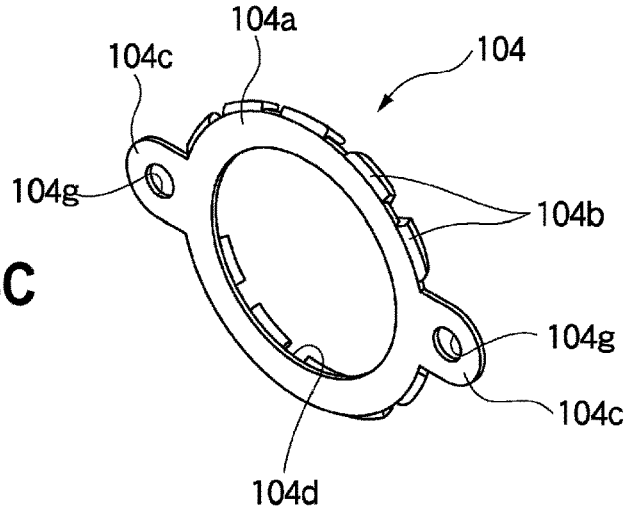
Figure 4A:
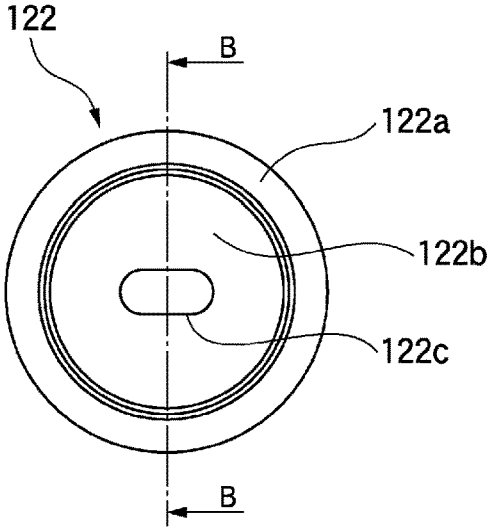
Figure 4B:
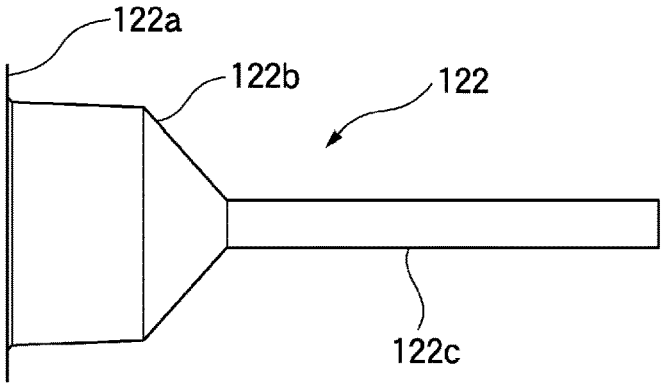
Figure 4C:
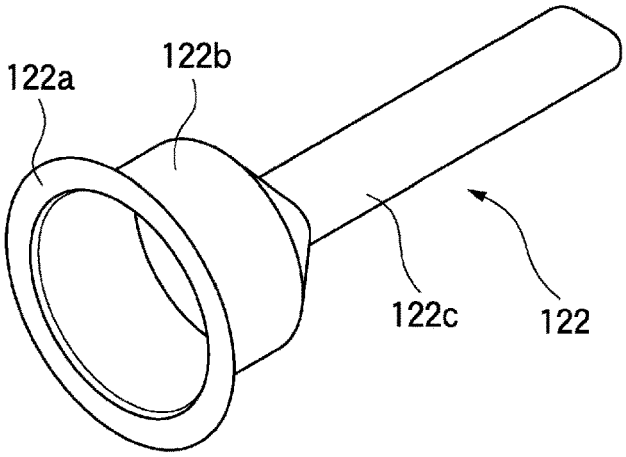
Figure 6A:
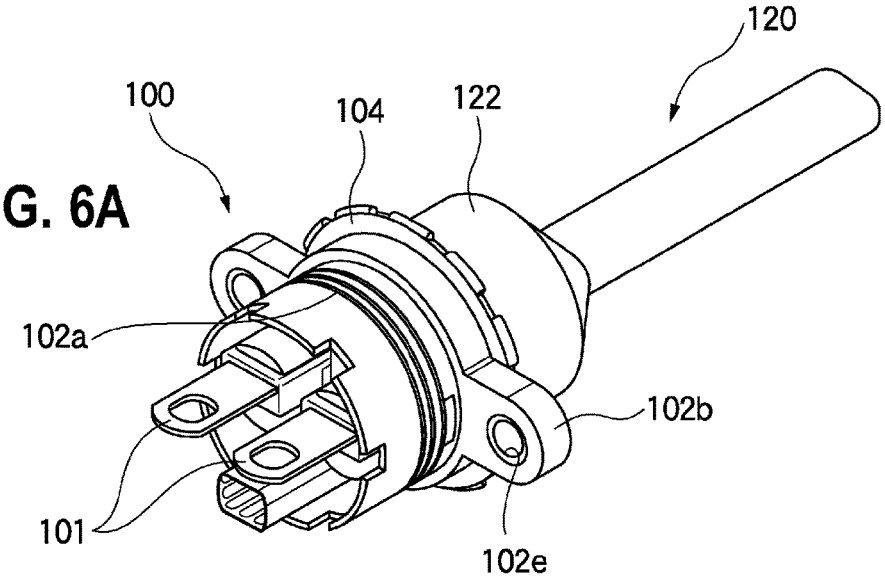
Figure 6B:
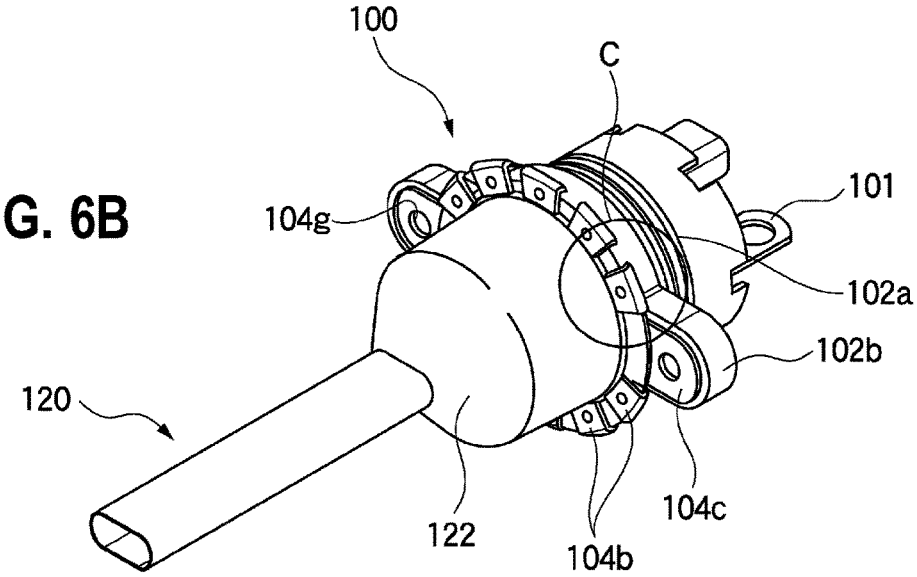
Figure 7:
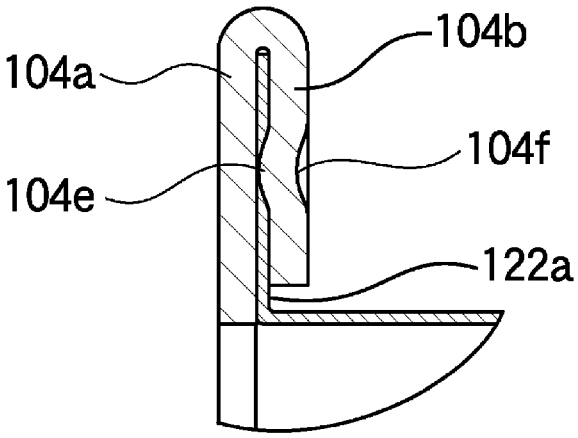
FIG. 7 is an enlarged sectional view of a main part (shell tightening piece) in the shield shell of the first embodiment of the present invention.
Figure 8:
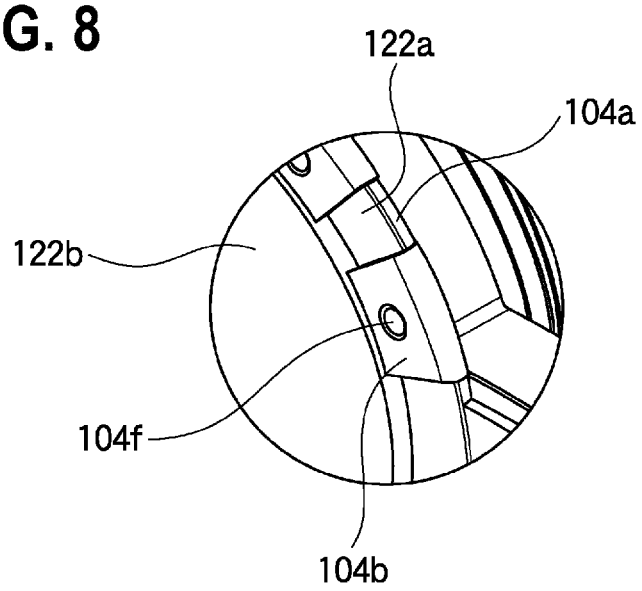
FIG. 8 is an enlarged figure of a C part of FIG. 6B.
Figure 9:
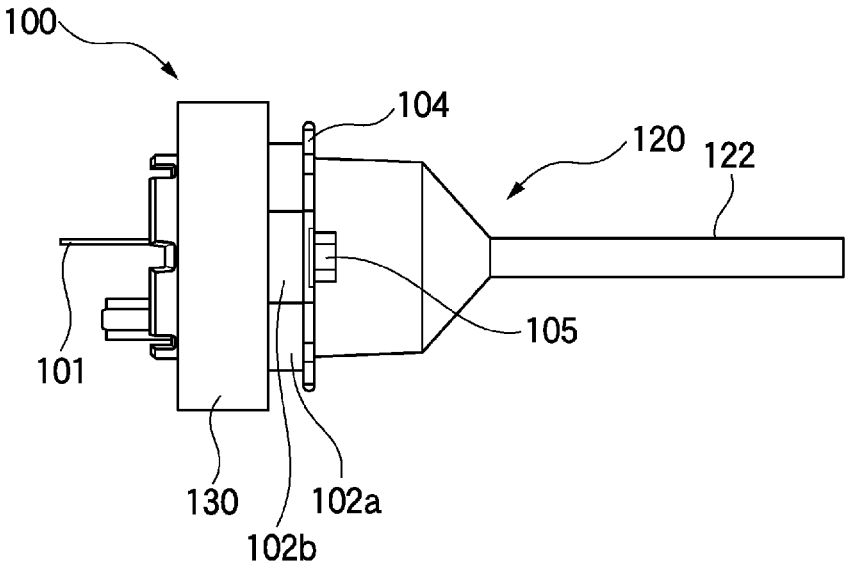
FIG. 9 is a side view in which the shield connector with electric wire of the first embodiment of the present invention is attached to the device side case.

FIG. 1 is an exploded perspective view of a shield connector with electric wire and a device side case of the first embodiment of the present invention. FIG. 2 is a perspective view in which the shield connector with electric wire of the first embodiment of the present invention is attached to the device side case. FIGS. 3A to 3C are figures to describe the shape of a shield shell of the first embodiment of the present invention, in which FIG. 3A is a front view, FIG. 3B is an A-A line sectional view of FIG. 3A, and FIG. 3C is a perspective view. FIGS. 4A to 4C are figures to describe the shape of a braiding of the first embodiment of the present invention, in which FIG. 4A is a front view, FIG. 4B is a B-B line sectional view of FIG. 4A, and FIG. 4C is a perspective view. FIGS. 5A to 5D are figures to describe an operation of attaching the braiding to the shield shell of the first embodiment of the present invention, in which FIGS. 5A to 5D are sectional views to respectively describe one step of the operation. FIGS. 6A and 6B are perspective views of the shield connector with electric wire of the first embodiment of the present invention, in which FIG. 6A is a perspective view watched from the front side of the shield connector with electric wire, and FIG. 6B is a perspective view watched from the rear side of the shield connector with electric wire. FIG. 7 is an enlarged sectional view of a main part (shell tightening piece) in the shield shell of the first embodiment of the present invention. FIG. 8 is an enlarged figure of a C part of FIG. 6B. FIG. 9 is a side view in which the shield connector with electric wire of the first embodiment of the present invention is attached to the device side case.

[Constitution of Each Member of the First Embodiment]

A shield connector with electric wire of the first embodiment of the present invention includes a shield connector 100 and a shield electric wire 120, as shown in FIG. 1. Various electronic devices such as an inverter or a motor are loaded in an electric automobile or a hybrid automobile, and when the shield connector 100 is inserted into an insertion hole 131 which a housing (hereinafter referred to as device side case) 130 of the electronic device is provided with, the electronic device and the shield electric wire 120 are connected. The constitution of the shield connector 100 is described in detail as follows.

The shield connector 100 includes male terminals 101, a housing 102, a rear holder 103, a shield shell 104 and bolts 105, as shown in FIGS. 1, 2, 6A and 6B.

The male terminal 101 is a metal member, and one end of the male terminal 101 is formed into a plate shape. The one end of the male terminal 101 is fitted into a female terminal (not shown) at the electronic device side when the shield connector 100 is inserted into the insertion hole 131 which the device side case 130 is provided with. On the other hand, the other end of the male terminal 101 is joined to an electric wire 121 of the shield electric wire 120 by various methods such as laser joining or supersonic wave joining. Thereby, the electronic device and the electric wires 121 are connected through the male terminals 101.

The housing 102 is a member which is molded by using resin material. The housing 102 includes a housing body 102*a* in which a terminal accommodating room, which accommodates the male terminals 101, is formed to hold the male terminals 101, two flanges 102*b* which are provided at the outer periphery of the housing body 102*a*, and a rear holder accommodating part 102*c* which is provided adjacently to the housing body 102*a*, and in which a rear holder accommodating room which is communicated with the terminal accommodating room of the housing body 102*a* is formed.

The housing body 102*a* is formed into a cylindrical shape as a whole, as shown in FIGS. 1 and 6A. The terminal accommodating room to accommodate the male terminals 101 is formed to penetrate through the housing body 102*a* along the direction in which the male terminals 101 are inserted. The terminal accommodating room has intervals in the height direction and in the widthwise direction in the surface which is perpendicular to the direction in which the male terminals 101 are inserted, and the intervals are the same as the board thicknesses in the height direction and in the widthwise direction in the surface which is perpendicular to the longitudinal direction of the male terminals 101. Thereby, the male terminals 101 which are accommodated in the terminal accommodating room are held in the terminal accommodating room. The outer diameter of one part of the housing body 102*a* is slightly smaller than the inner diameter of the insertion hole 131 which the device side case 130 is provided with. Thereby, when the housing body 102*a* is inserted into the insertion hole 131, the housing body 102*a* is provisionally held in the insertion hole 131. The outer diameter of the other part of the housing body 102*a* is bigger than the inner diameter of the insertion hole 131. Thereby, when the housing body 102*a* is inserted into the insertion hole 131, the other part of the housing body 102*a* contacts the device side case 130, and the housing body 102*a* is regulated from being further inserted. Further, a circular waterproofing packing may be provided on the outer periphery of the housing body 102*a*, and when the housing body 102*a* is inserted into the insertion hole 131, the waterproofing packing prevents water that reaches the space between the housing body 102*a* and the insertion hole 131 from invading.

The two flanges 102*b* are provided to project from the outer periphery of the housing body 102*a*, as shown in FIGS. 1, 2, 6A and 6B. These flanges 102*b* are arranged at positions facing each other across the center of the housing body 102*a*. Particularly, in this first embodiment, these flanges 102*b* are arranged at positions facing each other along the direction in which the male terminals 101, which are held in the housing body 102*a*, line up. These flanges 102*b* are respectively formed with bolt holes 102*e* which penetrate through the flanges 102*b* in the board thickness direction. On the other hand, the device side case 130 is provided with two bolt holes 132 to sandwich the insertion hole 131. The distance between these two bolt holes 132 is the same as the distance between the two bolt holes 102*e* which the flanges 102*b* are respectively provided with. When the housing body 102*a* is inserted into the insertion hole 131, the housing body 102*a* is aligned so that the positions of the bolt holes 132 which the device side case 130 is provided with correspond to the positions of the bolt holes 102*e* which the flanges 102*b* are provided with, as shown in FIG. 2.

The rear holder accommodating part 102*c* has a rear holder accommodating room into which the rear holder 103 which has held the male terminals 101 is inserted. At this time, while the male terminals 101 penetrate through the rear holder accommodating room of the rear holder accommodating part 102*c*, and further penetrate through the terminal accommodating room of the housing body 102*a*, the male terminals 101 are held in the terminal accommodating room of the housing body 102*a*. The rear holder accommodating part 102*c* is provided with an engaging mechanism 102*d* which engages with the rear holder 103 which is accommodated in the rear holder accommodating room. Thereby, the rear holder 103 is maintained to be accommodated in the rear holder accommodating part 102*c*.

The rear holder 103 is a member molded by using resin material. The rear holder 103 is formed by assembling a pair of half bodies, and the outer periphery of the half bodies is covered by a rubber stopper. The half bodies of the rear holder 103 are formed with through holes, and the electric wires 121 joined to the male terminals 101, when inserted into the through holes, are held by the inner surfaces of the through holes. In this way, the electric wires 121 are fixed to the rear holder 103. The rear holder 103 to which the electric wires 121 are fixed in this way holds the male terminals 101 that extend to one side and holds the electric wires 121 that extend to the opposite side, as shown in FIG. 1. The rear holder 103 is provided with an engaging mechanism 103*a* which engages with the rear holder accommodating part 102*c* when the rear holder 103 enters the rear holder accommodating part 102*c*. When this engaging mechanism 103*a* engages with the engaging mechanism 102*d* which the rear holder accommodating part 102*c* is provided with, the rear holder 103 is maintained to be accommodated in the rear holder accommodating part 102*c*.

The shield shell 104 is a metal member, and, as shown in FIGS. 1 to 3C, is formed as a whole into a circular shape to which the leading end in the longitudinal direction of a shield member, which is formed into a hollow tubular shape, is attached. The shield shell 104 is made by processing, or punch-pressing and bend-pressing a plate-like metal plate. The shield shell 104 includes a discal shell main body 104*a*, a plurality of shell tightening pieces 104*b* which are extended from the outer edge of the shell main body 104*a*, and two flanges 104*c* which are extended from the outer edge of the shell main body 104*a*.

As shown in FIGS. 3A to 3C, the outer edge of the shell main body 104*a* is formed into a round shape. Inside the shell main body 104*a*, a through hole 104*d* is bored. The inner edge of the shell main body 104*a* defining the through hole 104*d* is also formed into a round shape. The inner edge (the through hole 104*d*) of the shell main body 104*a* and the outer edge of the shell main body 104*a* which both form round shapes in this way are formed so that their centers correspond to each other. Therefore, the width in the radial direction between the inner edge of the shell main body 104*a* and the outer edge of the shell main body 104*a* is a constant distance except the places where the flanges 104*c* are extended. The shape of the outer edge of the shell main body 104*a* substantially match the shape of the outer edge of the bottom surface (surface connected to the rear holder accommodating part 102*c*) of the housing body 102*a*, as shown in FIGS. 2, 6A and 6B. In this first embodiment, it is described that the inner edge of the shell main body 104*a* and the outer edge of the shell main body 104*a* have perfect round shapes, but the inner edge and the outer edge may have elliptical shapes.

Figure 5A:
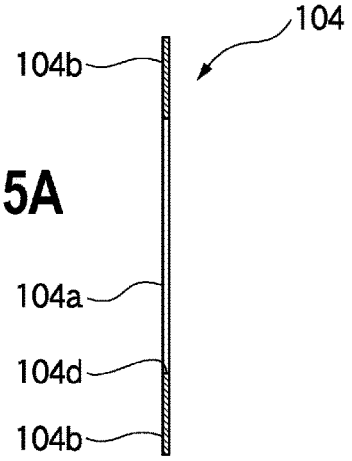
Figure 5B:
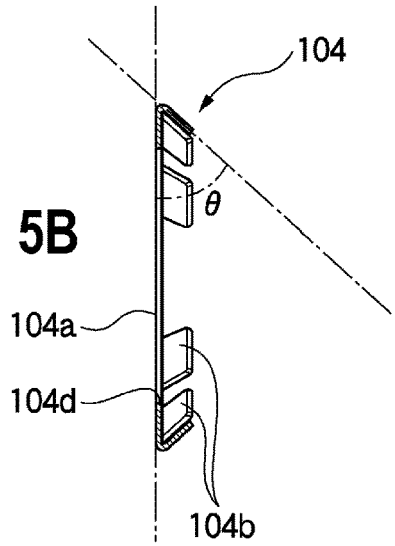

The shell tightening pieces 104*b*, which are rectangular pieces that are punch-pressed to extend outward radially from the outer edge of the shell main body 104*a*, as shown in FIG. 5A, are bend-pressed to the shell main body 104*a*, as shown in FIGS. 4A to 4C and 5B. Before the leading end in the longitudinal direction of the shield member is attached to the shield shell 104, as shown in FIG. 5B, the shell tightening pieces 104*b* are bent so that an angle θ between a plane including the shell main body 104*a* and the direction in which the shell tightening pieces 104*b* are extended is an acute angle (however, $0<\theta<90$ degrees). On the other hand, after the leading end in the longitudinal direction of the shield member is attached to the shield shell 104, as shown in FIGS. 2, 7 and 8, the shell tightening pieces 104*b* are bent so that the shell main body 104*a* and the shell tightening pieces 104*b* are substantially in parallel with each other, or in other words, the above angle θ becomes substantially 0.

In this first embodiment, the shell main body 104*a* is provided with five shell tightening pieces 104*b* above and below a line binding the two flanges 104*c*, respectively. The five shell tightening pieces 104*b* above and below are respectively provided equidistantly along the outer edge of the shell main body 104*a*. Therefore, as shown in FIG. 3A, the shell tightening pieces 104*b* are respectively located across the center of the round shape that the outer edge of the shell main body 104*a* forms (that is, at positions symmetric relative to the center).

The two flanges 104*c* are formed by being punch-pressed to extend outward radially from the outer edge of the shell main body 104*a*, as shown in FIGS. 3A to 3C. These flanges 104*c* are respectively formed with bolt holes 104*g* which penetrate through the flanges 104*c* in the board thickness direction. The distance between the two bolt holes 104*g* which these flanges 104*c* are respectively provided with is the same as the distance between the two bolt holes 102*e* which the flanges 102*b* of the housing 102 are respectively provided with. When the shield shell 104 is attached to the housing 102, the shield shell 104 is aligned so that the positions of the two bolt holes 102*e* which the flanges 102*b* of the housing 102 are respectively provided with correspond to the positions of the two bolt holes 104*g* which the flanges 104*c* of the shield shell 104 are respectively provided with, as shown in FIG. 2.

The two bolts 105 are metal members, and engage threadedly into the bolt holes 132 which the device side case 130 is provided with. When the shield connector 100 is attached to the device side case 130, as shown in FIG. 1, while the bolts 105 penetrate through the bolt holes 104*g* which the flanges 104*c* of the shield shell 104 are provided with and penetrate through the bolt holes 102*e* which the flanges 102*b* of the housing 102 are provided with, the bolts 105 engage threadedly into the bolt holes 132 which the device side case 130 is provided with. By fastening the two bolts 105 in this way, as shown in FIG. 2, the shield shell 104 is fixed to the housing 102 and the housing 102 is fixed to the device side case 130.

Now, it is necessary for the shield shell 104 to be grounded to the GND of the electronic device. In realizing this grounding, since the whole device side case 130 is made of metal and the bolt holes 132 of the device side case 130 are made of metal, the device side case 130 or the bolt holes 132 are kept electrically connected to the GND of the electronic device. Thus, by engaging threadedly and fastening the bolts 105 to the bolt holes 132, the shield shell 104 and the device side case 130 or the bolt holes 132 are electrically connected through the bolts 105. In this way, the GNDs of the shield shell 104 and the electronic device can be commonized.

Then, the constitution of the shield electric wire 120 is described. The shield electric wire 120 includes the electric wires 121 and a braiding 122.

The electric wire 121 is constructed of a core wire and an insulative coating which covers the core wire. The electric wires 121 are assembled to the rear holder 103 while the core wires are joined to the male terminals 101. In this first embodiment, as shown in FIGS. 1 and 2, the shield electric wire 120 is arranged so that the two electric wires are adjacent to each other. When the electronic device to which the shield connector 100 is connected is a device in need of the supply of a relatively big electric current such as an inverter or a motor, the shapes of the core wires and the insulative coatings of the electric wires 121 are designed according to the current value appropriately.

The braiding 122 is formed into a hollow tubular shape by braiding strands having conductivity. The braiding 122 is a member equivalent to the shield member. The braiding 122 may be formed by braiding strands which are made, for example, by plating elastic fiber such as nylon. As shown in FIGS. 1 and 2, the braiding 122 is arranged around the two electric wires 121 to cover the two electric wires 121. The shield member of the present invention is not limited to a braiding. A conductive member (for example, a metal foil or the like) which is formed into a hollow tubular shape can be applied as the shield member of the present invention.

[Procedure of Attaching the Braiding to the Shield Shell and Shield Structure]

Next, a procedure of attaching the braiding 122 to the shield shell 104 and a shield structure in which the braiding 122 is attached to the shield shell 104 are described. At first, a procedure of attaching the braiding 122 to the shield shell 104 is described with reference to FIGS. 5A to 5C.

At first, before the braiding 122 is attached to the shield shell 104, it is necessary to prepare the shield shell 104 and the braiding 122 beforehand. The shield shell 104 which has the shell main body 104*a*, the shell tightening pieces 104*b*, the flanges 104*c* and the through hole 104*d* is formed into a plate shape by punch-pressing a metal plate, as shown in FIG. 5A. Right after the shield shell 104 is punch-pressed, the shell tightening pieces 104*b* are extended on a plane including the shell main body 104*a*.

After the punch-pressing, as shown in FIG. 5B, the shell tightening pieces 104*b* are bended to the shell main body 104*a* by being bend-pressed. At this time, the shell tightening pieces 104*b* are bent so that an angle θ between a plane including the shell main body 104*a* and the direction in which the shell tightening pieces 104*b* are extended is an acute angle (however, $0<\theta<90$ degrees). Using the shield shell 104 formed in this way, the following steps are carried out.

On the other hand, for the braiding 122, an end of the braiding 122 is processed to be widened toward one longitudinal end of the braiding 122, as shown in FIGS. 4A to 4C. Specifically, the diameter of the braiding 122 increases in an order of a small diameter part 122*c* which covers the two electric wires 121 at a position that is the nearest to the electric wires 121, a diameter enlarging part 122*b* which extends from the end of the small diameter part 122*c* and whose diameter is enlarged progressively from the small diameter part 122*c*, and a leading end 122*a* which extends from the end of the diameter enlarging part 122*b* on a plane which is perpendicular to the longitudinal direction of the braiding 122. The end, at the side of the leading end 122*a*, of the diameter enlarging part 122*b* is formed into a circular shape, and the diameter of the end is bigger than the diameter of the through hole 104*d*. Thereby, when the braiding 122 is attached to the shield shell 104, the end, at the side of the leading end 122*a*, of the diameter enlarging part 122*b* can accommodate the through hole 104*d* inside. In this first embodiment, the leading end 122*a* is expanded in the radial direction of the diameter enlarging part 122*b* from the whole periphery in the circumferential direction of the end of the diameter enlarging part 122*b*, but the leading end 122*a* may be developed from part of the periphery in the circumferential direction of the end of the diameter enlarging part 122*b*. More specifically, the leading end 122*a* may be provided to extend from the diameter enlarging part 122*b* in places corresponding to the shell tightening pieces 104*b* of the shield shell 104.

Figure 5C:
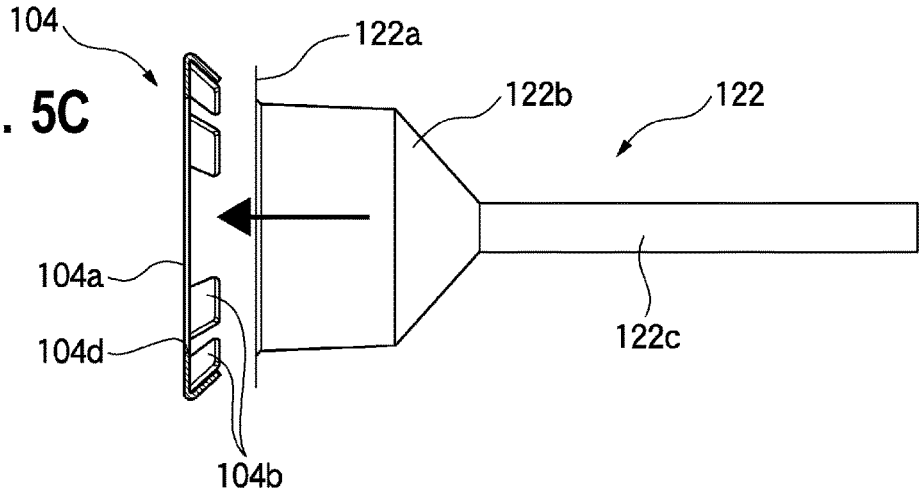

Using the shield shell 104 and the braiding 122 formed in this way, the braiding 122 is attached to the shield shell 104. At first, as shown in FIG. 5C, the braiding 122 is brought close toward the shield shell 104, and the leading end 122*a* of the braiding 122 is arranged between the shell main body 104*a* and all the shell tightening pieces 104*b* which make the angle θ. By arranging the leading end 122*a* in this way, the leading end 122*a* is arranged at the shell main body 104*a* to surround the through hole 104*d*.

Figure 5D:
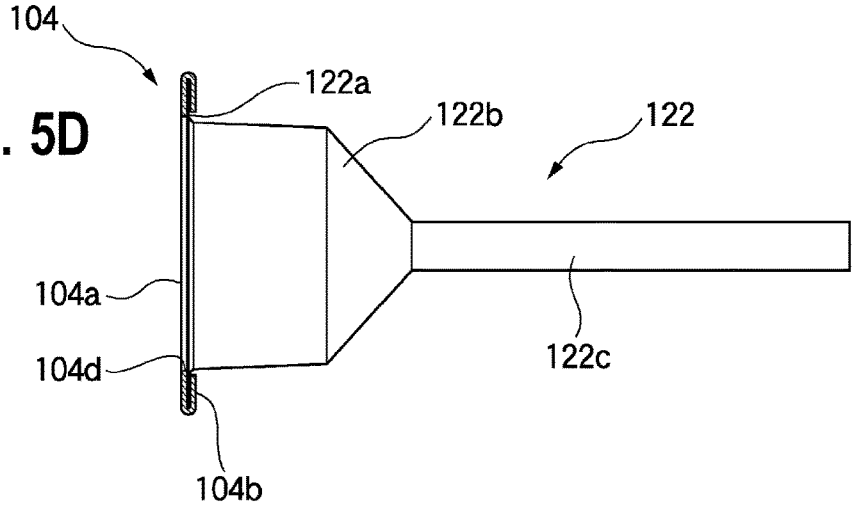

Then, as shown in FIG. 5D, the shell tightening pieces 104*b* are further bend-pressed toward the shell main body 104*a* until the shell main body 104*a* and the shell tightening pieces 104*b* become substantially in parallel with each other. The shell tightening pieces 104*b* which are bent to the shell main body 104*a* in this way extend toward the center of the through hole 104*d*. Thereby, the leading end 122*a* is clamped by the shell main body 104*a* and the shell tightening pieces 104*b* In this way, the shield structure in which the braiding 122 is attached to the shield shell 104 is completed.

Here, before the leading end in the longitudinal direction of the braiding 122 is attached to the shield shell 104, by bending the shell tightening pieces 104*b* to form the angle θ with the shell main body 104*a* as shown in FIG. 5B, the following effect is obtained. When the braiding 122 is attached to the shield shell 104, the leading end 122*a* enters along the surface of the shell main body 104*a* toward the radial outside of the shell main body 104*a*. Then, the leading end 122*a* abuts against the bent shell tightening pieces 104*b*, and a further entry is regulated. In this way, the leading end 122*a* is positioned by the shell tightening pieces 104*b*. Since the leading end 122*a* is positioned by all the shell tightening pieces 104*b*, the leading end 122*a* can be arranged at the position conforming to the shape of the through hole 104*d*. As a result, arranging the leading end 122*a* to conform to the shape of the through hole 104*d* can be implemented by a simple operation. In this way, the operation of attaching the braiding 122 to the shield shell 104 can be performed efficiently. This effect is obtained when the angle θ is an acute angle, but when it is considered that the shell tightening pieces 104*b* are further bend-pressed toward the shell main body 104*a* in the step shown in FIG. 5D, it is preferable that the shell tightening pieces 104*b* are bent surely to the shell main body 104*a* by setting the angle θ to around 45 degrees.

In the shield structure in which the braiding 122 is attached to the shield shell 104 shown in FIG. 5D, the braiding 122 is grounded to the GND of the electronic device through the shield shell 104. In this way, for the shield structure of the present invention, a shielding function is implemented by the shield shell 104 and the braiding 122.

Now, in FIG. 5D, the structure in which the leading end 122*a* is clamped by the shell main body 104*a* and the shell tightening pieces 104*b* is described. In this first embodiment, to further raise the gripping force of the shell main body 104*a* and the shell tightening pieces 104*b* to grip the leading end 122*a*, a structure shown in FIG. 7 is adopted in the shell tightening pieces 104*b*. As shown in FIG. 7, the shell tightening pieces 104*b* are provided with protrusions 104*e*, on the surfaces which face the shell main body 104*a* when the shell tightening pieces 104*b* are bent to the shell main body 104*a*. With these protrusions 104*e*, when the shell tightening pieces 104*b* are bent until the shell tightening pieces 104*b* are substantially in parallel with the shell main body 104*a*, the leading end 122*a* is clamped by the shell main body 104*a* and the protrusions 104*e* by a big pressure force. Therefore, the leading end 122*a* is fixed to the shield shell 104 more strongly by the shell main body 104*a* and the shell tightening pieces 104*b*. Thus, the braiding 122 can be prevented from falling off from the shield shell 104. If the protrusions 104*e* enter the gaps between fibers in the braiding 122, even if an external force acts onto the braiding 122 in a direction of escaping from the shield shell 104, the braiding 122 is prevented from escaping from the shield shell 104 since the protrusions 104*e* are caught onto those fibers.

For example, the above protrusions 104*e* are formed at the time of bend-pressing shown in FIG. 5D by locally pushing surfaces opposite to the surfaces where the protrusions 104*e* are provided in the shell tightening pieces 104*b*. In this case, as shown in FIGS. 7 and 8, the shell tightening pieces 104*b* are formed with concaves 104*f* at positions corresponding to the protrusions 104*e* at surfaces opposite to the surfaces where the protrusions 104*e* are provided. Thus, by forming the protrusions 104*e* at the time of bend-pressing, the protrusions 104*e* can be easily formed at the shell tightening pieces 104*b*. If the protrusions 104*e* are formed by locally pushing the surfaces opposite to the surfaces where the protrusions 104*e* are formed, it becomes easy to adjust the projection height of the protrusions 104*e* which project from the shell tightening pieces 104*b*. The method to form the protrusions 104*e* is not limited to the above method. The protrusions 104*e* may be formed at the time of punch-pressing shown in FIG. 5A, and the protrusions 104*e* may be formed at desired places on the plate-like metal plate before pressing.

Then, the shield structure in which the braiding 122 is attached to the shield shell 104 as shown in FIG. 5D is attached to the housing 102 of the shield connector 100. As shown in FIGS. 6A and 6B, the shield structure of the present invention is attached to the housing 102, by making the two flanges 102*b* of the housing 102 and the two flanges 104*c* of the shield shell 104 opposed to each other. The shield connector with electric wire is completed in this way.

After this, as shown in FIGS. 2 and 9, the shield connector with electric wire is attached to the device side case 130. At this time, the shield connector with electric wire is aligned so that the housing body 102*a* is inserted into the insertion hole 131, and the positions of the bolt holes 132 which the device side case 130 is provided with correspond to the positions of the bolt holes 102*e* which the flanges 102*b* are provided with. While the bolts 105 penetrate through the bolt holes 104*g* which the flanges 104*c* of the shield shell 104 are provided with and the bolt holes 102*e* which the flanges 102*b* of the housing 102 are provided with, the bolts 105 engage threadedly into the bolt holes 132 which the device side case 130 is provided with. By fastening the two bolts 105 in this way, the shield shell 104 is fixed to the housing 102 and the housing 102 is fixed to the device side case 130.

[Effect of the First Embodiment]

According to the first embodiment of the present invention above, upon attaching the braiding 122 to the shield shell 104, a shield ring used traditionally becomes needless. Therefore, the component number of the shield connector 100 can be reduced. Even if the component number decreases in this way, a shielding function is maintained by the shield structure constructed of the shield shell 104 and the braiding 122. Thus, compared with a traditional shield connector, the component cost of the shield connector 100, whose component number decreases while the shielding function is maintained, can be reduced. As a result, the cost of a wire harness in which the shield connector is included as a component can be reduced.

The shield shell 104 adopted in the shield connector 100 has a shape which is molded only by punch-pressing and bend-pressing. Therefore, the manufacturing method can be simplified in comparison with a traditional manufacturing method of manufacturing a shield shell by twist-pressing or die-casting. Therefore, the manufacturing cost to manufacture the shield shell 104 can be reduced. As a result, the cost of a wire harness in which the shield connector is included as a component can be reduced.

In the first embodiment of the present invention, the shell tightening pieces 104*b* are provided equidistantly along the outer edge of the shell main body 104*a*. As a result of this construction, the shell main body 104*a* and the shell tightening pieces 104*b* can grip the leading end 122*a* of the braiding 122 equidistantly along the circumferential direction. Therefore, even if an external force acts onto the braiding 122 in a direction of escaping from the shield shell 104, an internal force to resist the external force acts uniformly onto the leading end 122*a* of the braiding 122 along the circumferential direction. Thereby, since the internal force locally acts on a part of the leading end 122*a* of the braiding 122, it can be prevented that the part of the braiding 122 is damaged.

In the first embodiment of the present invention, the shell tightening pieces 104*b* are provided with the protrusions 104*e*. As a result of this construction, the leading end 122*a* is clamped by the shell main body 104*a* and the protrusions 104*e* by a big pressure force. Therefore, the leading end 122*a* is fixed to the shield shell 104 more strongly by the shell main body 104*a* and the shell tightening pieces 104*b*. If the protrusions 104*e* enter the gaps between fibers in the braiding 122, even if an external force acts onto the braiding 122 in a direction of escaping from the shield shell 104, the protrusions 104*e* are caught onto those fibers. Thus, the braiding 122 can be prevented from escaping from the shield shell 104.

In the first embodiment of the present invention, the concaves 104*f* are formed at positions corresponding to the protrusions 104*e* at surfaces opposite to the surfaces where the protrusions 104*e* are provided. As a result of this construction, by forming the protrusions 104*e* at the time of bend-pressing, the protrusions 104*e* can be easily formed at the shell tightening pieces 104*b*. Further, it becomes easy to adjust the projection height of the protrusions 104*e* which project from the shell tightening pieces 104*b*.

In the first embodiment of the present invention, the shell tightening pieces 104*b* which are bent to the shell main body 104*a* extend toward the center of the through hole 104*d*. As a result of this construction, a range that is wider than the leading end 122*a* of the braiding 122 can be gripped by the shell main body 104*a* and the shell tightening pieces 104*b*. Therefore, the leading end 122*a* can be fixed to the shield shell 104 more strongly.

In the first embodiment of the present invention, the inner edge (the through hole 104*d*) of the shell main body 104*a* and the outer edge of the shell main body 104*a* are formed so that their centers match. As a result of this construction, the braiding 122 can be attached to the center of the shell main body 104*a*. Thereby, the shell tightening pieces 104*b* can be formed into the same shape and the shape of the shield shell 104 can be formed more simply. The present invention also includes that the braiding 122 is attached at a position eccentric from the center of the shell main body 104*a*. Even if the braiding 122 is attached at the position eccentric from the center of the shell main body 104*a*, by designing the extended length of the shell tightening pieces 104*b* appropriately, the braiding 122 can be attached to the shield shell 104.

In the first embodiment of the present invention, it is described that the shield structure of the present invention is applied to the shield connector 100, but the present invention is not limited to this. It is also possible that upon connecting the leading end of the shield electric wire 120 to the electronic device, while the electric wires 121 pass the through hole 104*d*, the shield shell 104 to which the braiding 122 is attached is directly fixed to the device side case 130, and the device side case 130 and the shield shell 104 are electrically connected.

Subsequently, the second embodiment of the present invention is described.

Second Embodiment

Figure 10:
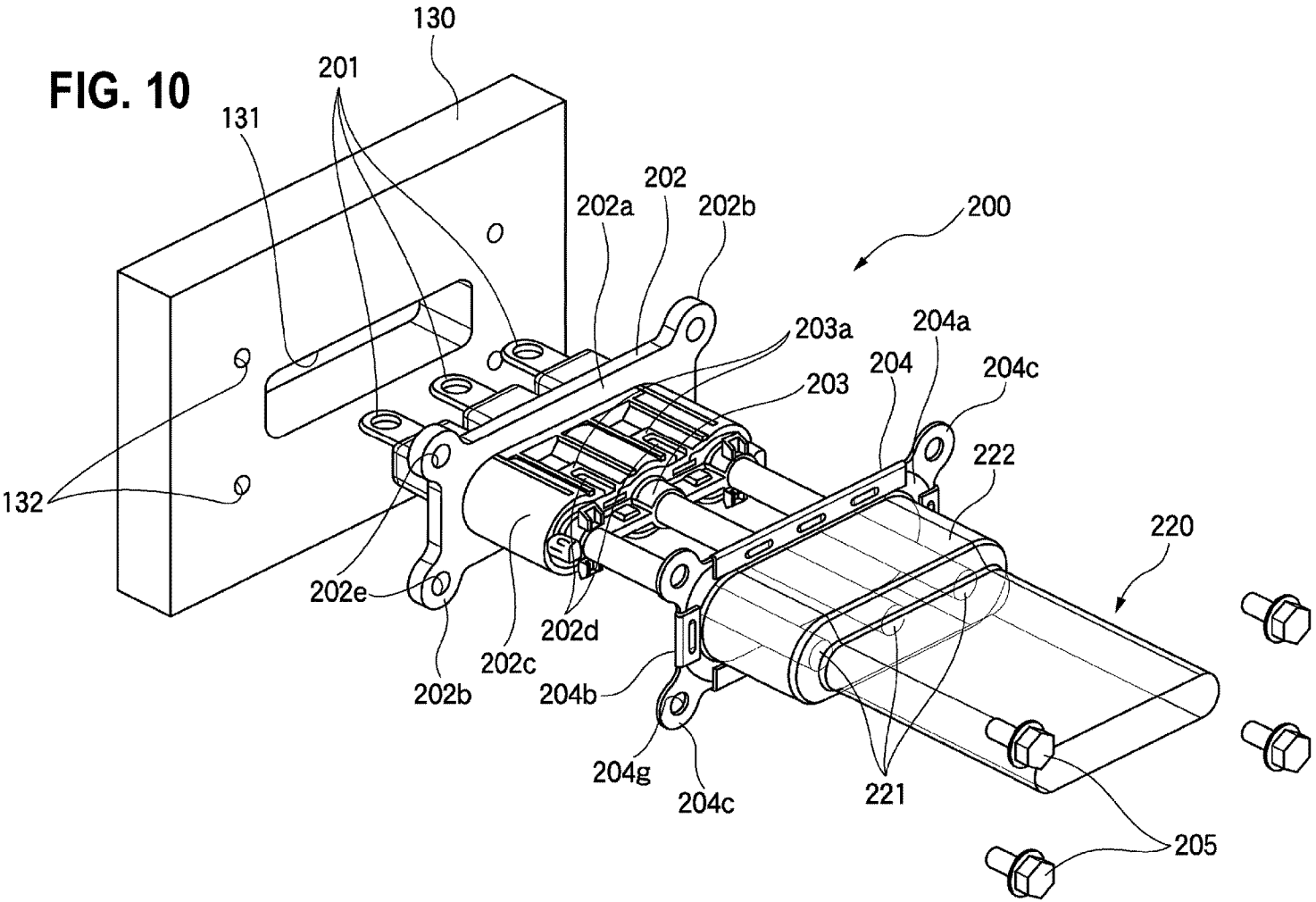
FIG. 10 is an exploded perspective view of a shield connector with electric wire and a device side case of the second embodiment of the present invention.
Figure 11:
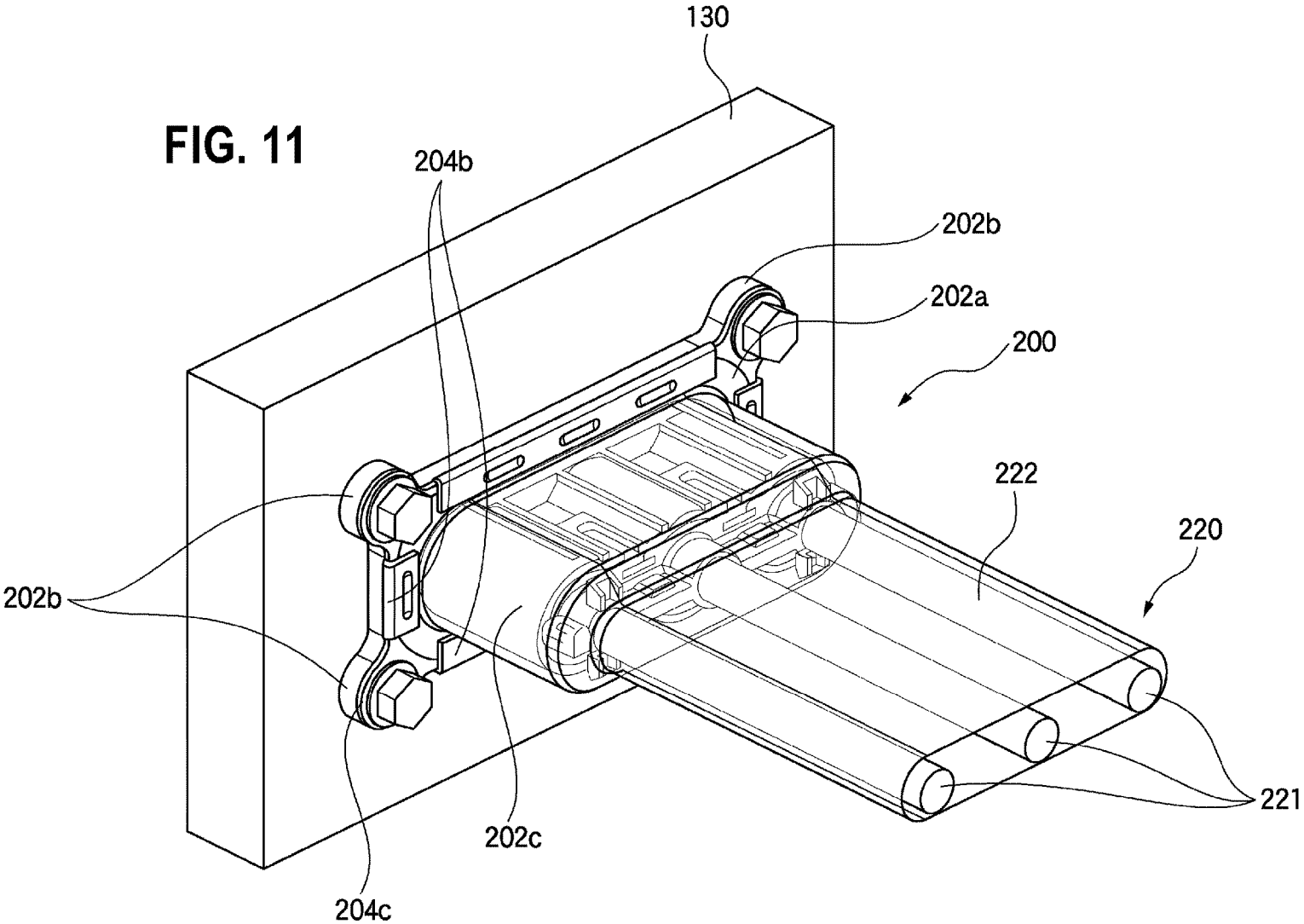
FIG. 11 is a perspective view in which the shield connector with electric wire of the second embodiment of the present invention is attached to the device side case.
Figure 12A:
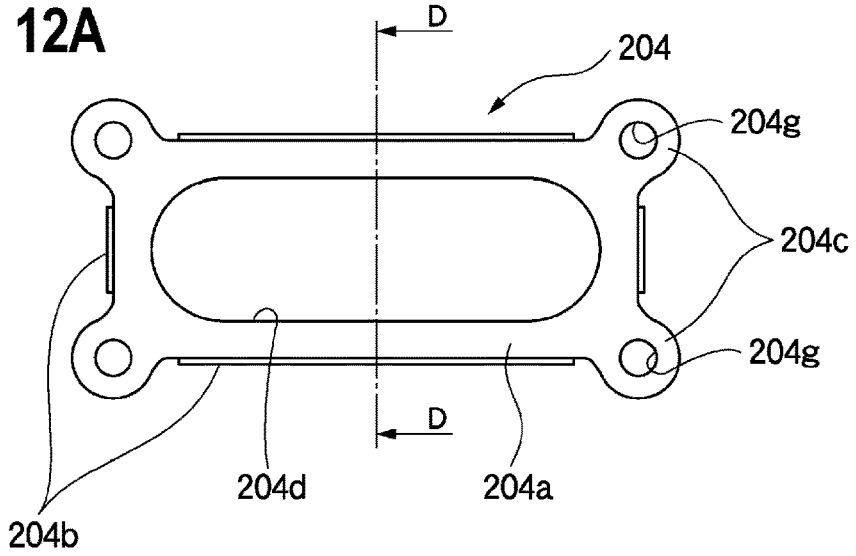
Figure 12B:
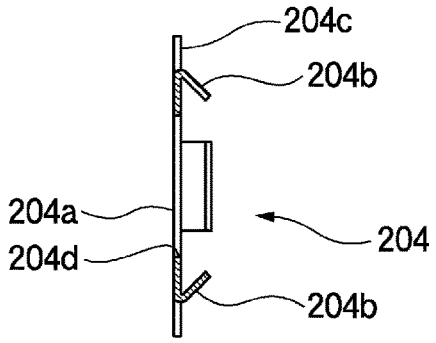
Figure 12C:
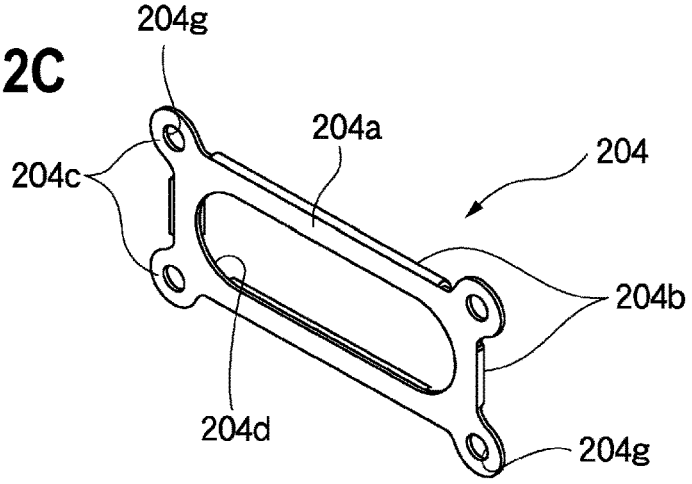
Figure 13:
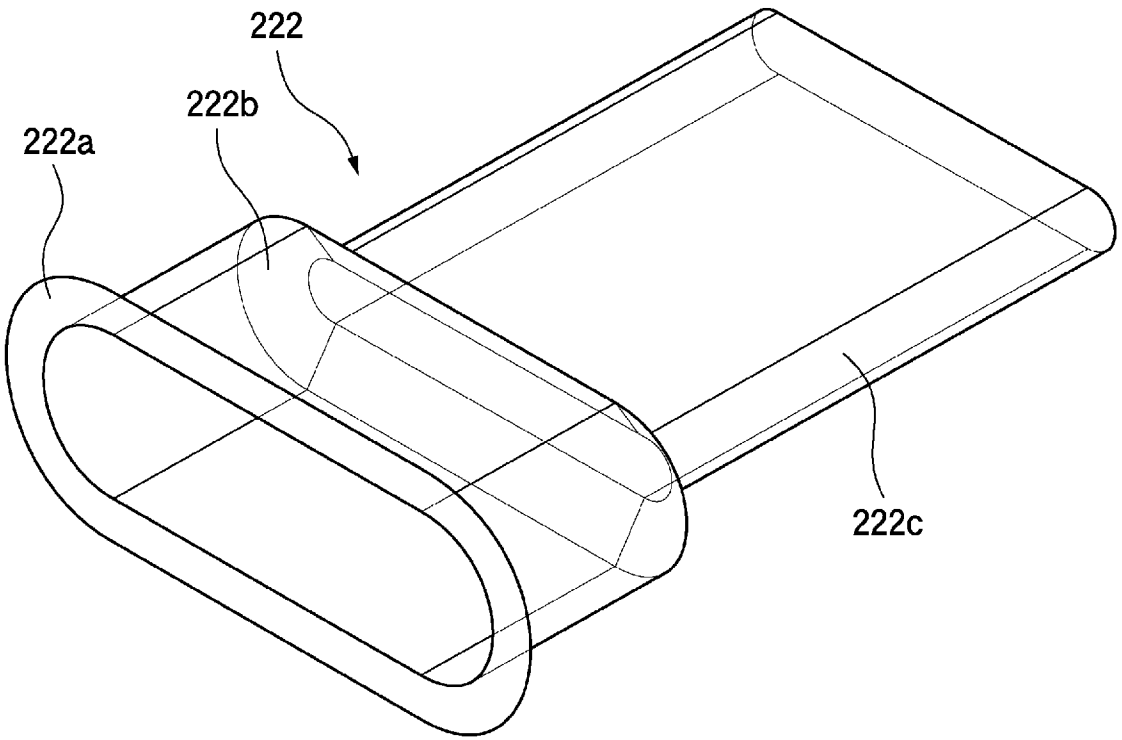
FIG. 13 is a perspective view to describe the shape of a braiding of the second embodiment of the present invention.
Figure 14A:
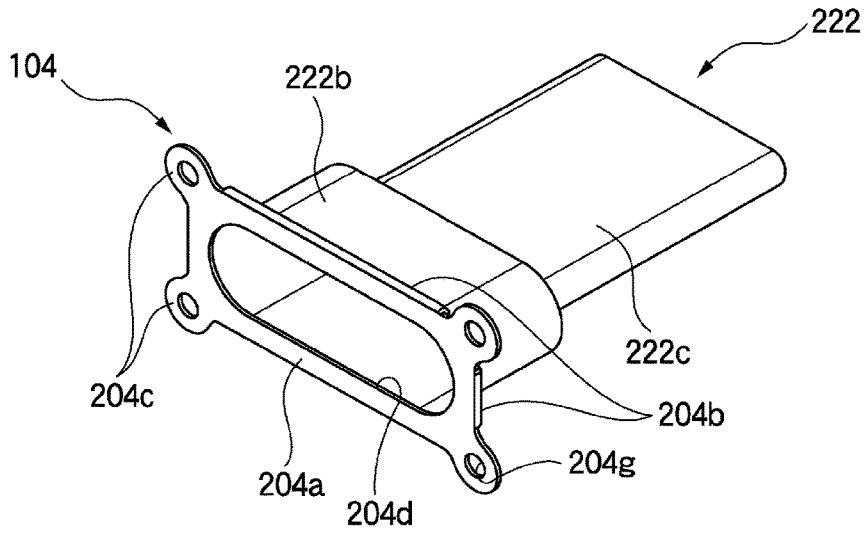
Figure 14B:
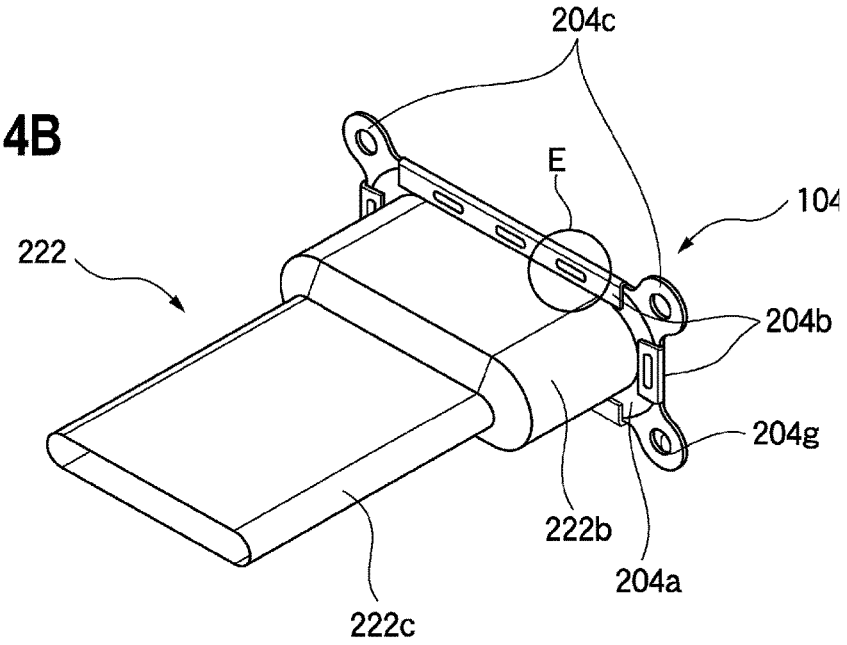
Figure 15:
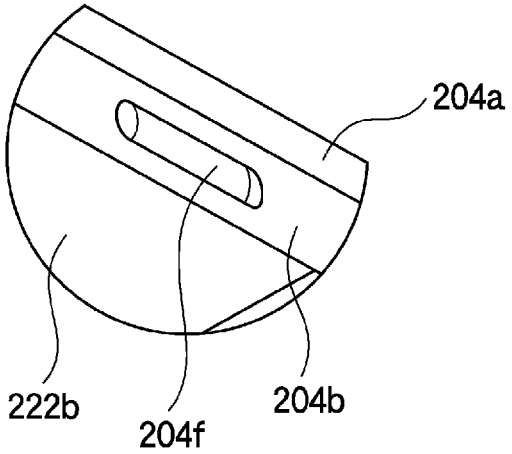
FIG. 15 is an enlarged figure of an E part of FIG. 14B.

FIG. 10 is an exploded perspective view of a shield connector with electric wire and a device side case of the second embodiment of the present invention. FIG. 11 is a perspective view in which the shield connector with electric wire of the second embodiment of the present invention is attached to the device side case. FIGS. 12A to 12C are figures to describe the shape of a shield shell of the second embodiment of the present invention, in which FIG. 12A is a front view, FIG. 12B is a D-D line sectional view of FIG. 12A, and FIG. 12C is a perspective view. FIG. 13 is a perspective view to describe the shape of a braiding of the second embodiment of the present invention. FIGS. 14A and 14B are perspective views to describe a shield structure of the second embodiment the present invention, in which FIG. 14A is a perspective view watched from the front side of the shield structure, and FIG. 14B is a perspective view watched from the rear side of the shield structure. FIG. 15 is an enlarged figure of an E part of FIG. 14B.

[Constitution of Each Member of the Second Embodiment]

A shield connector with electric wire of the second embodiment of the present invention includes a shield connector 200 and a shield electric wire 220, as shown in FIG. 10. The function of the shield connector 200 is similar to that of the shield connector 100 described in the first embodiment. The constitution of the shield connector 200 is described in detail as follows.

The shield connector 200 includes male terminals 201, a housing 202, a rear holder 203, a shield shell 204 and bolts 205, as shown in FIGS. 10 and 11.

The male terminals 201 are the same members as the male terminals 101 described in the first embodiment. An electronic device and electric wires 221 are connected through the male terminals 201.

The housing 202 is different in shape from the housing 102 described in the first embodiment, but is a member having a similar function. The housing 202 is a member which is molded by using resin material. The housing 202 includes a housing body 202*a* in which a terminal accommodating room, which accommodates the male terminals 201, is formed to hold the male terminals 201, four flanges 202*b* which are provided at the outer periphery of the housing body 202*a*, and a rear holder accommodating part 202*c* which is provided adjacently to the housing body 202*a*, and in which a rear holder accommodating room which is communicated with the terminal accommodating room of the housing body 202*a* is formed.

The housing body 202*a* is formed into a cuboid shape as a whole, as shown in FIGS. 10 and 11. The terminal accommodating room to accommodate the male terminals 201 is formed to penetrate through the housing body 202*a* along the direction in which the male terminals 201 are inserted. The terminal accommodating room has intervals in the height direction and in the widthwise direction in the surface which is perpendicular to the direction in which the male terminals 201 are inserted, and the intervals are the same as the board thicknesses in the height direction and in the widthwise direction in the surface which is perpendicular to the longitudinal direction of the male terminals 201. Thereby, the male terminals 201 which are accommodated in the terminal accommodating room are held in the terminal accommodating room. The outer diameter of one part of the housing body 202*a* is slightly smaller than the inner diameter of an insertion hole 131 which a device side case 130 is provided with. Thereby, when the housing body 202*a* is inserted into the insertion hole 131, the housing body 202*a* is provisionally held in the insertion hole 131. The outer diameter of the other part of the housing body 202*a* is bigger than the inner diameter of the insertion hole 131. Thereby, when the housing body 202*a* is inserted into the insertion hole 131, the other part of the housing body 202*a* contacts the device side case 130, and the housing body 102*a* is regulated from being further inserted.

The four flanges 202*b* are provided to project from the outer periphery of the housing body 202*a*, as shown in FIGS. 10 and 11. These flanges 202*b* are arranged at positions facing each other across the center of the housing body 202*a*. Particularly, in this second embodiment, two of these flanges 202*b* are arranged to line up at positions respectively above and below the male terminals 201 which are held in the housing body 202*a*. These flanges 202*b* are respectively formed with bolt holes 202*e* which penetrate through the flanges 202*b* in the board thickness direction. On the other hand, the device side case 130 is provided with four bolt holes 132 to sandwich the insertion hole 131. These four bolt holes 132 are formed at positions corresponding to the four bolt holes 202*e* which the flanges 202*b* are respectively provided with. When the housing body 202*a* is inserted into the insertion hole 131, the housing body 202*a* is aligned so that the positions of the bolt holes 132 which the device side case 130 is provided with correspond to the positions of the bolt holes 202*e* which the flanges 202*b* are provided with, as shown in FIG. 2.

The rear holder accommodating part 202*c* has a rear holder accommodating room into which the rear holder 203 which has held the male terminals 201 is inserted. At this time, while the male terminals 201 penetrate through the rear holder accommodating room of the rear holder accommodating part 202*c*, and further penetrate through the terminal accommodating room of the housing body 202*a*, the male terminals 101 are held in the terminal accommodating room of the housing body 202*a*. The rear holder accommodating part 202*c* is provided with an engaging mechanism 202*d* which engages with the rear holder 203 which is accommodated in the rear holder accommodating room. Thereby, the rear holder 203 is maintained to be accommodated in the rear holder accommodating part 202*c*.

The rear holder 203 is different in shape from the rear holder 103 described in the first embodiment, but is a member having a similar function. The rear holder 203 is a member which is molded by using resin material. The electric wires 221 joined to the male terminals 201, when inserted into through holes, are held by the inner surfaces of the through holes. In this way, the electric wires 121 are fixed to the rear holder 103. The rear holder 203 to which the electric wires 121 are fixed in this way holds the male terminals 201 that extend to one side and holds the electric wires 221 that extend to the opposite side, as shown in FIG. 10. The rear holder 203 is provided with an engaging mechanism 203*a* which engages with the rear holder accommodating part 202*c* when the rear holder 203 enters the rear holder accommodating part 202*c*. When this engaging mechanism 203*a* engages with the engaging mechanism 202*d* which the rear holder accommodating part 202*c* is provided with, the rear holder 203 is maintained to be accommodated in the rear holder accommodating part 202*c*.

The shield shell 204 is a metal member, and, as shown in FIGS. 10 to 12C, is formed as a whole into a circular shape to which the leading end in the longitudinal direction of a braiding, which is formed into a hollow tubular shape, is attached. The shield shell 204 is made by processing, or punch-pressing and bend-pressing a plate-like metal plate. The shield shell 204 includes a rectangular shell main body 204*a*, a plurality of shell tightening pieces 204*b* which are extended from the outer edge of the shell main body 204*a*, and four flanges 204*c* which are extended from the outer edge of the shell main body 204*a*.

As shown in FIGS. 12A to 12C, the outer edge of the shell main body 204*a* is formed into a rectangular shape. Inside the shell main body 204*a*, a through hole 204*d* is bored. The inner edge of the shell main body 204*a* defining the through hole 204*d* is formed into a rectangular shape whose four corners are rounded. The shape of the outer edge of the shell main body 204*a* and the shape of the inner edge of the shell main body 204*a* are similar to each other. The inner edge (the through hole 204*d*) of the shell main body 204*a* and the outer edge of the shell main body 204*a* which both form rectangular shapes in this way are formed so that their centers correspond to each other. Therefore, the vertical and horizontal widths between the inner edge of the shell main body 204*a* and the outer edge of the shell main body 204*a* are a constant distance except the places where the flanges 204*c* are extended. The shape of the outer edge of the shell main body 204*a* substantially match the shape of the outer edge of the bottom surface (surface connected to the rear holder accommodating part 202*c*) of the housing body 202*a*, as shown in FIG. 11. In this second embodiment, it is described that the inner edge of the shell main body 204*a* and the outer edge of the shell main body 204*a* have rectangular shapes, but the inner edge and the outer edge are not limited to the rectangular shapes, and it is possible to apply any polygonal shapes. The four corners of the inner edge of the shell main body 204*a* are rounded, but the shape of the corners can be changed appropriately depending on the shape of the rear holder accommodating part 202*c*.

As shown in FIGS. 12A to 12C, the shell tightening pieces 204*b*, which are rectangular pieces that are punch-pressed to extend outward from the outer edge of the shell main body 204*a*, are bend-pressed to the shell main body 204*a*. Before the leading end in the longitudinal direction of the braiding 222 is attached to the shield shell 204, as shown in FIG. 12B, the shell tightening pieces 204*b*, like the shell tightening pieces 104*b* of the first embodiment, are bent so that an angle θ between a plane including the shell main body 204*a* and the direction in which the shell tightening pieces 204*b* are extended is an acute angle (however, $0<\theta<90$ degrees). On the other hand, after the leading end in the longitudinal direction of the braiding 222 is attached to the shield shell 204, as shown in FIGS. 10, 11 and 14B, the shell tightening pieces 204*b* are bent so that the shell main body 204*a* and the shell tightening pieces 204*b* are substantially in parallel with each other, or in other words, the above angle θ becomes substantially 0.

In this second embodiment, the four sides of the rectangular shell main body 204*a* are respectively provided with the shell tightening pieces 204*b*. The top and bottom shell tightening pieces 204*b* which are opposed to each other have the same shape, and the right and left shell tightening pieces 204*b* which are opposed to each other also have the same shape. Therefore, the shell tightening pieces 204*b* exist respectively at positions which are symmetrical vertically and horizontally, as shown in FIGS. 12A to 12C.

The four flanges 204*c* are formed by being punch-pressed to extend outward from the corners of the outer edge of the shell main body 204*a*, as shown in FIGS. 12A to 12C. These flanges 204*c* are respectively formed with bolt holes 204*g* which penetrate through the flanges 204*c* in the board thickness direction. The bolt holes 204*g* which these flanges 204*c* are respectively provided with are provided at positions corresponding to the bolt holes 202*e* which these flanges 202*b* of the housing 202 are respectively provided with. When the shield shell 204 is attached to the housing 202, the shield shell 204 is aligned so that the positions of the bolt holes 202*e* which the flanges 202*b* of the housing 202 are respectively provided with correspond to the positions of the bolt holes 204*g* which the flanges 204*c* of the shield shell 204 are respectively provided with, as shown in FIG. 11.

Each of the four bolts 205 is the same member as the bolt 105 described in the first embodiment. By fastening the four bolts 205, as shown in FIG. 11, the shield shell 204 is fixed to the housing 202 and the housing 202 is fixed to the device side case 130.

Then, the constitution of the shield electric wire 220 is described. The shield electric wire 220 includes the electric wires 221 and a braiding 222.

The electric wires 221 are members similar to the electric wires 121 described in the first embodiment.

The braiding 222 is a member similar to the braiding 122 described in the first embodiment. As shown in FIGS. 10 and 11, the braiding 222 is arranged around three electric wires 121 to cover the three electric wires 121.

[Procedure of Attaching the Braiding to the Shield Shell and Shield Structure]

Next, a procedure of attaching the braiding 222 to the shield shell 204 and a shield structure in which the braiding 222 is attached to the shield shell 204 are described.

At first, before the braiding 222 is attached to the shield shell 204, it is necessary to prepare the shield shell 204 and the braiding 222 beforehand. The shield shell 204, like the shield shell 104 of the first embodiment, which has the shell main body 204*a*, the shell tightening pieces 204*b*, the flanges 204*c* and the through hole 204*d*, is formed into a plate shape by punch-pressing a metal plate. Right after the shield shell 204 is punch-pressed, the shell tightening pieces 204*b* are extended on a plane including the shell main body 204*a*.

After the punch-pressing, as shown in FIG. 12B, the shell tightening pieces 204*b* are bended to the shell main body 204*a* by being bend-pressed. At this time, the shell tightening pieces 204*b* are bent so that an angle θ between a plane including the shell main body 204*a* and the direction in which the shell tightening pieces 104*b* are extended is an acute angle (however, $0<\theta<90$ degrees). Using the shield shell 204 formed in this way, the following steps are carried out.

On the other hand, for the braiding 222, an end of the braiding 222 is processed to be widened toward one longitudinal end of the braiding 222, as shown in FIG. 13. Specifically, the diameter of the braiding 222 increases in an order of a small diameter part 222*c* which covers the three electric wires 221 at a position that is the nearest to the electric wires 221, a diameter enlarging part 222*b* which extends from the end of the small diameter part 222*c* and whose diameter is enlarged progressively from the small diameter part 222*c*, and a leading end 222*a* which extends from the end of the diameter enlarging part 222*b* on a plane which is perpendicular to the longitudinal direction of the braiding 222. The end, at the side of the leading end 222*a*, of the diameter enlarging part 222*b* is formed into a rectangular shape whose four corners are rounded, and the size of the end is bigger than the diameter of the through hole 204*d*. Thereby, when the braiding 222 is attached to the shield shell 204, the end, at the side of the leading end 222*a*, of the diameter enlarging part 222*b* can accommodate the through hole 204*d* inside. In this second embodiment, the leading end 222*a* is expanded in the radial direction of the diameter enlarging part 222*b* from the whole periphery in the circumferential direction of the end of the diameter enlarging part 222*b*, but the leading end 222*a* may be developed from part of the periphery in the circumferential direction of the end of the diameter enlarging part 222*b*. More specifically, the leading end 222*a* may be provided to extend from the diameter enlarging part 222*b* in places corresponding to the shell tightening pieces 204*b* of the shield shell 204.

Using the shield shell 204 and the braiding 222 formed in this way, the braiding 222 is attached to the shield shell 204. The attaching method is similar to the method described with reference to FIGS. 5C and 5D in the first embodiment. At first, the braiding 222 is brought close toward the shield shell 204, and the leading end 222*a* of the braiding 222 is arranged between the shell main body 204*a* and all the shell tightening pieces 204*b* which make the angle θ. By arranging the leading end 222*a* in this way, the leading end 222*a* is arranged at the shell main body 204*a* to surround the through hole 204*d*.

Then, the shell tightening pieces 204*b* are further bend-pressed toward the shell main body 204*a* until the shell main body 204*a* and the shell tightening pieces 204*b* become substantially in parallel with each other. The shell tightening pieces 204*b* which are bent to the shell main body 204*a* in this way extend toward the center of the through hole 204*d*. Thereby, the leading end 222*a* is clamped by the shell main body 204*a* and the shell tightening pieces 204*b*. In this way, the shield structure in which the braiding 222 is attached to the shield shell 204 is completed.

In this second embodiment, like the first embodiment, the shell tightening pieces 204*b* may also be provided with protrusions (equivalent to the protrusions 104*e* of the first embodiment.) on the surfaces which face the shell main body 104*a* when the shell tightening pieces 204*b* are bent toward the shell main body 104*a*. Thereby, the gripping force by which the leading end 222*a* is gripped by the shell main body 204*a* and the shell tightening pieces 204*b* can be further raised. If the protrusions enter the gaps between fibers in the braiding 222, even if an external force acts onto the braiding 222 in a direction of escaping from the shield shell 204, the braiding 222 is prevented from escaping from the shield shell 204 since the protrusions are caught onto those fibers. In this case, for example, the above protrusions are formed at the time of bend-pressing by locally pushing surfaces opposite to the surfaces where the protrusions are provided in the shell tightening pieces 204*b*. In this case, as shown in FIGS. 14B and 15, the shell tightening pieces 204*b* are formed with concaves 204*f* at positions corresponding to the protrusions at surfaces opposite to the surfaces where the protrusions are provided. Thus, by forming the protrusions at the time of bend-pressing, the protrusions can be easily formed at the shell tightening pieces 204*b*. If the protrusions are formed by locally pushing the surfaces opposite to the surfaces where the protrusions are formed, it becomes easy to adjust the projection height of the protrusions 104*e* which project from the shell tightening pieces 204*b*.

Then, the shield structure in which the braiding 222 is attached to the shield shell 204 as shown in FIGS. 14A and 14B is attached to the housing 202 of the shield connector 200. The shield structure of the present invention is attached to the housing 202, by making the four flanges 202*b* of the housing 202 and the four flanges 204*c* of the shield shell 204 opposed to each other. The shield connector with electric wire is completed in this way.

After this, as shown in FIG. 11, the shield connector with electric wire is attached to the device side case 130. At this time, the shield connector with electric wire is aligned so that the housing body 202*a* is inserted into the insertion hole 131, and the positions of the bolt holes 132 which the device side case 130 is provided with correspond to the positions of the bolt holes 202*e* which the flanges 202*b* are provided with. While the bolts 205 penetrate through the bolt holes 204*g* which the flanges 204*c* of the shield shell 204 are provided with and the bolt holes 202*e* which the flanges 202*b* of the housing 202 are provided with, the bolts 105 engage threadedly into the bolt holes 132 which the device side case 130 is provided with. By fastening the four bolts 205 in this way, the shield shell 204 is fixed to the housing 202 and the housing 202 is fixed to the device side case 130.

[Effect of the Second Embodiment]

According to the second embodiment of the present invention above, upon attaching the braiding 222 to the shield shell 204, a shield ring used traditionally becomes needless. Therefore, the component number of the shield connector 200 can be reduced. Even if the component number decreases in this way, a shielding function is maintained by the shield structure constructed of the shield shell 204 and the braiding 222. Thus, compared with a traditional shield connector, the component cost of the shield connector 200, whose component number decreases while the shielding function is maintained, can be reduced. As a result, the cost of a wire harness in which the shield connector is included as a component can be reduced.

The shield shell 204 adopted in the shield connector 200 has a shape which is molded only by punch-pressing and bend-pressing. Therefore, the manufacturing method can be simplified in comparison with a traditional manufacturing method of manufacturing a shield shell by twist-pressing or die-casting. Therefore, the manufacturing cost to manufacture the shield shell 204 can be reduced. As a result, the cost of a wire harness in which the shield connector is included as a component can be reduced.

In the second embodiment of the present invention, the shell tightening pieces 204*b* which are bent to the shell main body 204*a* extend toward the center of the through hole 204*d*. As a result of this construction, a range that is wider than the leading end 222*a* of the braiding 222 can be gripped by the shell main body 204*a* and the shell tightening pieces 204*b*. Therefore, the leading end 222*a* can be fixed to the shield shell 204 more strongly.

In the second embodiment of the present invention, the inner edge (the through hole 204*d*) of the shell main body 204*a* and the outer edge of the shell main body 204*a* are formed so that their centers match. As a result of this construction, the braiding 222 can be attached to the center of the shell main body 204*a*. Thereby, the length by which the shell tightening pieces 204*b* are extended from the shell main body 204*a* can be made uniform, and the shape of the shield shell 204 can be formed more simply. The present invention also includes that the braiding 222 is attached at a position eccentric from the center of the shell main body 204*a*. Even if the braiding 222 is attached at the position eccentric from the center of the shell main body 204*a*, by designing the extended length of the shell tightening pieces 204*b* appropriately, the braiding 222 can be attached to the shield shell 204.

In the second embodiment of the present invention, it is described that the shield structure of the present invention is applied to the shield connector 200, but the present invention is not limited to this. It is also possible that upon connecting the leading end of the shield electric wire 220 to the electronic device, while the electric wires 221 pass the through hole 204*d*, a shield shell 240 to which the braiding 222 is attached is directly fixed to a device side case 230, and the device side case 130 and the shield shell 240 are electrically connected.

The features of the embodiments of the shield structure, the shield shell and the method of manufacturing the shield connector with electric wire according to the present invention described above are briefly, collectively listed in the following [1] to [10], respectively.

[1] A shield structure, including a shield member (braiding 122, 222) which is formed into a hollow tubular shape, and a shield shell (104, 204) to which the leading end in the longitudinal direction of the shield member is attached, wherein the shield shell has a plate-like shell main body (104*a*, 204*a*) through which a through hole (104*d*, 204*d*) is bored, and a plurality of shell tightening pieces (104*b*, 204*b*) which are extended from the outer edge of the shell main body, the shell main body is so arranged that the leading end (122*a*, 222*a*) in the longitudinal direction of the shield member surrounds the through hole, and the leading end in the longitudinal direction of the shield member is clamped by the shell main body and the shell tightening pieces which are bent to the shell main body.

[2] The shield structure according to [1], wherein the shell tightening pieces are provided equidistantly along the outer edge of the shell main body.

[3] The shield structure according to [1] or [2], wherein the shell tightening pieces are provided with protrusions (104*e*) on surfaces which face the shell main body when the shell tightening pieces are bent to the shell main body.

[4] The shield structure according to [3], wherein the shell tightening pieces are formed with concaves (104*f*) at positions corresponding to the protrusions on surfaces opposite to the surfaces where the protrusions are provided.

[5] The shield structure according to any one of [1] to [4], wherein the shell tightening pieces which are bent to the shell main body extend toward the center of the through hole.

[6] The shield structure according to any one of [1] to [5], wherein the shape of the through hole of the shell main body and the shape that defines the outer edge of the shell main body are round, and the center of the through hole corresponds to the center of the shape of the outer edge of the shell main body.

[7] The shield structure according to any one of [1] to [5], wherein the shape of the through hole of the shell main body and the shape that defines the outer edge of the shell main body are rectangles that are similar to each other, and the center of the through hole corresponds to the center of the shape of the outer edge of the shell main body.

[8]A shield shell, including a plate-like shell main body through which a through hole is bored, and a plurality of shell tightening pieces which are extended from the outer edge of the shell main body, wherein the leading end in the longitudinal direction of a shield member which is arranged to surround the through hole may be clamped by the shell main body and the shell tightening pieces which are bent to the shell main body.

[9] The shield shell according to [8], wherein an angle between a plane including the shell main body and a direction in which the shell tightening pieces are extended is an acute angle.

[10]A method of manufacturing a shield connector with electric wire, including a pressing step of forming a shield shell which has a plate-like shell main body through which a through hole is bored, and a plurality of shell tightening pieces which are extended from the outer edge of the shell main body by pressing a metal plate, an arranging step of arranging the leading end in the longitudinal direction of a shield member which is formed into a hollow tubular shape to the shell main body to surround the through hole, and a bending step of clamping the leading end in the longitudinal direction of the shield member with the shell main body and the shell tightening pieces by bending the shell tightening pieces to the shell main body.

Although the invention is described in detail with reference to the specific embodiments, it is apparent that various modifications and amendments may be made by those skilled in the art without departing from the spirit and scope of the invention.

According to the present invention, effects are achieved that the component number of the shield connector is reduced and the shield connector with electric wire can be manufactured by a simpler manufacturing method. The present invention that achieves the above effects is useful in the structure of a shield shell.

What is claimed is:

1. A shield structure, comprising:

a shield member including one of a braiding and a foil, each having a hollow tubular shape; and a shield shell, wherein the shield shell has a plate-like shell main body through which a through hole is bored, and a plurality of shell tightening pieces which are extended from an outer edge of the shell main body, a leading end in a longitudinal direction of the shield member is configured to be located relative to the shell main body to surround the through hole when the shield member is clamped to the shield shell, and each of the shell tightening pieces has a first position at which the shell tightening pieces extend at an acute angle to the shell main body when the shield member is entirely spaced away from each of the shield shell main body and the shell tightening pieces, the leading end of the shield member is inserted into a respective space between the shell body and each of the shell tightening pieces when the shell tightening pieces are in the first position, and a final position after the leading end of the shell member is inserted into the respective spaces, and in the final position, the shell tightening pieces extend substantially parallel to the shell main body such that the shield member abuts the shell main body and is clamped by the shell main body and the shell tightening pieces.

2. The shield structure according to claim 1, wherein the shell tightening pieces are provided equidistantly along the outer edge of the shell main body.

3. The shield structure according to claim 1, wherein the shell tightening pieces are provided with protrusions on surfaces which face the shell main body when the shell tightening pieces are bent to the shell main body.

4. The shield structure according to claim 3, wherein the shell tightening pieces are formed with concaves at positions corresponding to the protrusions on surfaces opposite to the surfaces where the protrusions are provided.

5. The shield structure according to claim 1, wherein the shield member is positioned by the shell tightening pieces and is arranged at a position conforming to a shape of the through hole before the shield member is clamped by the shell main body and the shell tightening pieces.

6. A shield shell comprising:

a plate-like shell main body through which a through hole is bored; and a plurality of shell tightening pieces which are extended from an outer edge of the shell main body and bent at an acute angle relative to the shell main body, the shell tightening pieces and the shell main body are a unitary structure and define a respective space between the shell main body and each of the shell tightening pieces, wherein the shell main body is configured to receive a leading end in a longitudinal direction of a shield member against the shell main body to surround the through hole by inserting the leading end of the shield member into the respective spaces between the shell main body and each of the shell tightening pieces when each of the shell tightening pieces are bent at an acute angle, and the shell main body and the shell tightening pieces are configured to clamp the leading end of the shell member by further bending the shell tightening pieces into the respective spaces after the leading end of the shield member is inserted between the shell main body and the tightening pieces.

7. The shield shell according to claim 6, wherein the shield member is positioned by the shell tightening pieces and is arranged at a position conforming to a shape of the through hole before the shield member is clamped by the shell main body and the shell tightening pieces.

8. A method of manufacturing a shield connector comprising:

a pressing step of forming a shield shell which has a plate-like shell main body through which a through hole is bored, and a plurality of shell tightening pieces which are extended from an outer edge of the shell main body, by pressing a metal plate;

a bending step of bending the plurality of tightening pieces to a an initial orientation such that each of the tightening pieces extends from the shell main body at an acute angle and define a respective space between the shell main body and each of the shell tightening pieces;

an inserting step of inserting into each of the respective spaces a leading end in a longitudinal direction of a shield member which is formed into a hollow tubular shape between the shell main body and each of the tightening pieces to surround the through hole when the plurality of tightening pieces are in the initial orientation; and a clamping step of clamping directly the leading end in the longitudinal direction of the shield member with the shell main body and the shell tightening pieces by bending the shell tightening pieces to the shell main body after the leading end is inserted into each of the respective spaces.

9. The method according to claim 8, wherein the inserting step includes inserting the leading end of the shield member between the shell main body and the shell tightening pieces after the bending step of bending the plurality of tightening pieces to the initial orientation.

10. The method according to claim 9, wherein the inserting step includes positioning of the shield member by the shell tightening pieces at a position conforming to a shape of the through hole before the clamping step of clamping the leading end in the longitudinal direction of the shield member with the shell main body and the shell tightening pieces.

* * * * *